US012569738B2

(12) United States Patent
Nikiforov

(10) Patent No.: US 12,569,738 B2
(45) Date of Patent: Mar. 10, 2026

(54) PORTABLE GOAL FOR PLAYING A GAME

(71) Applicant: Dmitrii Nikiforov, Gainesville, FL (US)

(72) Inventor: Dmitrii Nikiforov, Gainesville, FL (US)

( * ) Notice: Subject to any disclaimer, the term of this patent is extended or adjusted under 35 U.S.C. 154(b) by 804 days.

(21) Appl. No.: 17/819,979

(22) Filed: Aug. 16, 2022

(65) Prior Publication Data

US 2023/0055330 A1 Feb. 23, 2023

Related U.S. Application Data

(60) Provisional application No. 63/259,866, filed on Aug. 19, 2021.

(51) Int. Cl.

| | |
|---|---|
| ***A63B 63/00*** | (2006.01) |
| ***A63B 67/00*** | (2006.01) |
| *A63B 71/02* | (2006.01) |

(52) U.S. Cl.

CPC ..... *A63B 63/007* (2013.01); *A63B 67/002* (2013.01); *A63B 2063/002* (2013.01); *A63B 2071/024* (2013.01); *A63B 2210/50* (2013.01)

(58) Field of Classification Search

CPC .... A63B 63/007; A63B 67/002; A63B 63/004
See application file for complete search history.

(56) References Cited

U.S. PATENT DOCUMENTS

| | | | | |
|---|---|---|---|---|
| 5,599,024 | A * | 2/1997 | Acuff | A63B 63/004 473/400 |
| 6,966,852 | B2 * | 11/2005 | Yoon | A63B 71/023 473/421 |
| 8,807,568 | B1 * | 8/2014 | Ruder | A63B 67/002 273/342 |
| 9,272,200 | B2 * | 3/2016 | Ziemkowski | A63C 19/065 |
| 9,427,655 | B1 * | 8/2016 | Moody | A63B 67/002 |
| 9,987,536 | B2 * | 6/2018 | Nash | A63B 63/004 |
| 2010/0221974 | A1 * | 9/2010 | Monaghan | A47D 13/04 446/227 |

FOREIGN PATENT DOCUMENTS

| | | | | |
|---|---|---|---|---|
| DE | 202014104618 | U1 * | 11/2014 | F16B 7/02 |
| GB | 2268950 | A * | 1/1994 | A63B 63/004 |
| GB | 2470223 | A * | 11/2010 | A63B 63/004 |
| WO | WO-2006043041 | A1 * | 4/2006 | A63B 63/004 |

* cited by examiner

*Primary Examiner* — Magdalena Topolski
(74) *Attorney, Agent, or Firm* — Saliwanchik, Lloyd & Eisenschenk

(57) ABSTRACT

A device and methods for playing a game are provided. The game utilizes a goal. In one embodiment, the goal resembles a cube. A user can stand outside the perimeter of the goal and can throw an object, such as, for example, a ball, into the goal. The size of the goal can be adjustable.

20 Claims, 25 Drawing Sheets

PORTABLE GOAL FOR PLAYING A GAME

CROSS-REFERENCE TO A RELATED APPLICATION

This application claims the benefit of U.S. Provisional Application Ser. No. 63/259,866, filed Aug. 19, 2021, the disclosure of which is hereby incorporated by reference in its entirety, including all figures, tables and amino acid or nucleic acid sequences.

BACKGROUND OF INVENTION

Over the years countless games have been invented that incorporate two teams scoring into a goal: basketball, soccer, football, hockey, etc. All those games require two goals, and the goals are two-dimensional. All those games count a goal scored if the ball of the game crosses through a particular part of a two-dimensional plane.

However, those games fail to provide a ball game having the features described below wherein the goal is in a shape in three-dimensional space.

The subject invention provides a goal for playing a unique ball game. The goal can have four, five, six, or more sides. In a specific embodiment, the goal forms a 6-sided polyhedron that is a cube. To play the game, a player can stand outside a court perimeter around the goal and throw an object, such as, for example, a ball into the goal. The goal can be adjustable in size.

SUMMARY OF THE INVENTION

A game device for playing a unique game is provided by the embodiments of the subject invention. The game device includes a goal that can have four, five, six, or more sides that form openings. In one embodiment, the goal has six sides that form a polyhedron in the shape of a cube. A player can stand outside a court perimeter around the goal and can throw an object, such as, for example, a ball into an opening in the goal. The goal can be adjustable in size.

The game device of the subject invention can be used to play a game wherein a player can score by throwing an object, such as a ball, into an opening of the goal, while another player tries to defend the goal.

Advantageously, the goal can be light-weight and easy to transport and utilizes components that are easily assembled and can be dissembled on site.

And another advantage of the present device is to provide a game that does not require a big court to play.

And another advantage of the present device is to provide a game that is inexpensive to produce and fun to play.

For a more complete understanding of the above listed features and advantages of the goal for playing the unique game described above, reference should be made to the following detailed description. Further, additional features and advantages of the invention will be apparent to those of skill in the art having benefit of the detailed description, and such variations are within the scope of the present invention.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description are specific to the embodiments disclosed. Any variation of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which.

DETAILED DESCRIPTION

Embodiments of the subject invention pertain to a game device and method for playing a game. The game device includes a goal arranged within a perimeter and the method comprises tossing a game ball into the game device to score points. A goal with a court perimeter there around for playing a game is provided in the embodiments of the subject invention. A player can play the game by standing outside the court perimeter around the goal and throwing a ball, or other object, into the goal, which can be defended by another player.

To facilitate understanding, the subject invention will be described in the context of playing a game that utilizes different embodiments of the subject invention. As the ordinary artisan can readily understand there are numerous game variations and other uses that would be applicable to embodiments of the subject invention. Thus, unless where specifically stated, the subject invention is not limited by the description of the game herein.

Game Set

Figure 1:
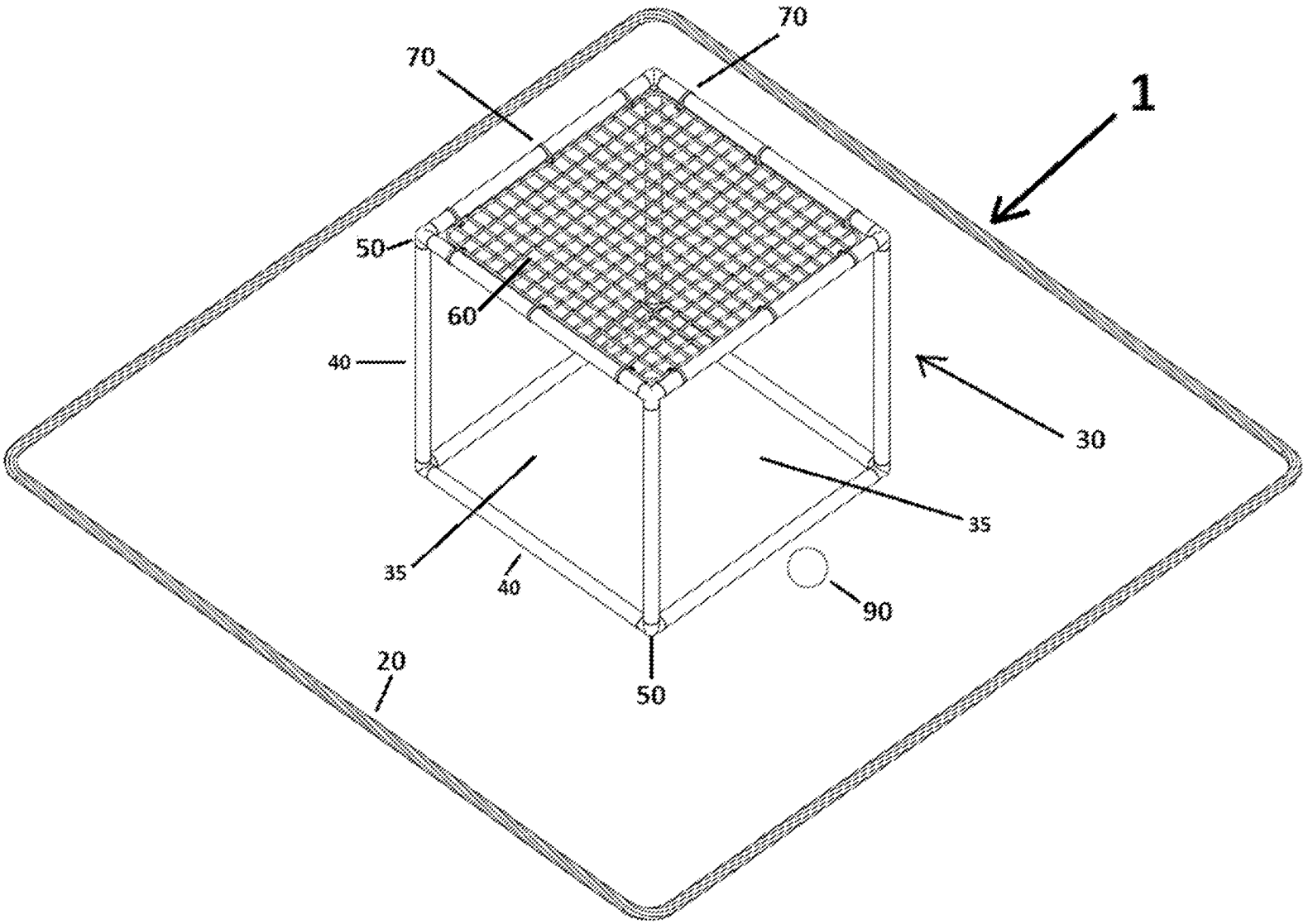
FIG. 1 illustrates a front perspective view of an embodiment of a goal and object, shown here as a ball, which can be used to play a game.
Figure 2:
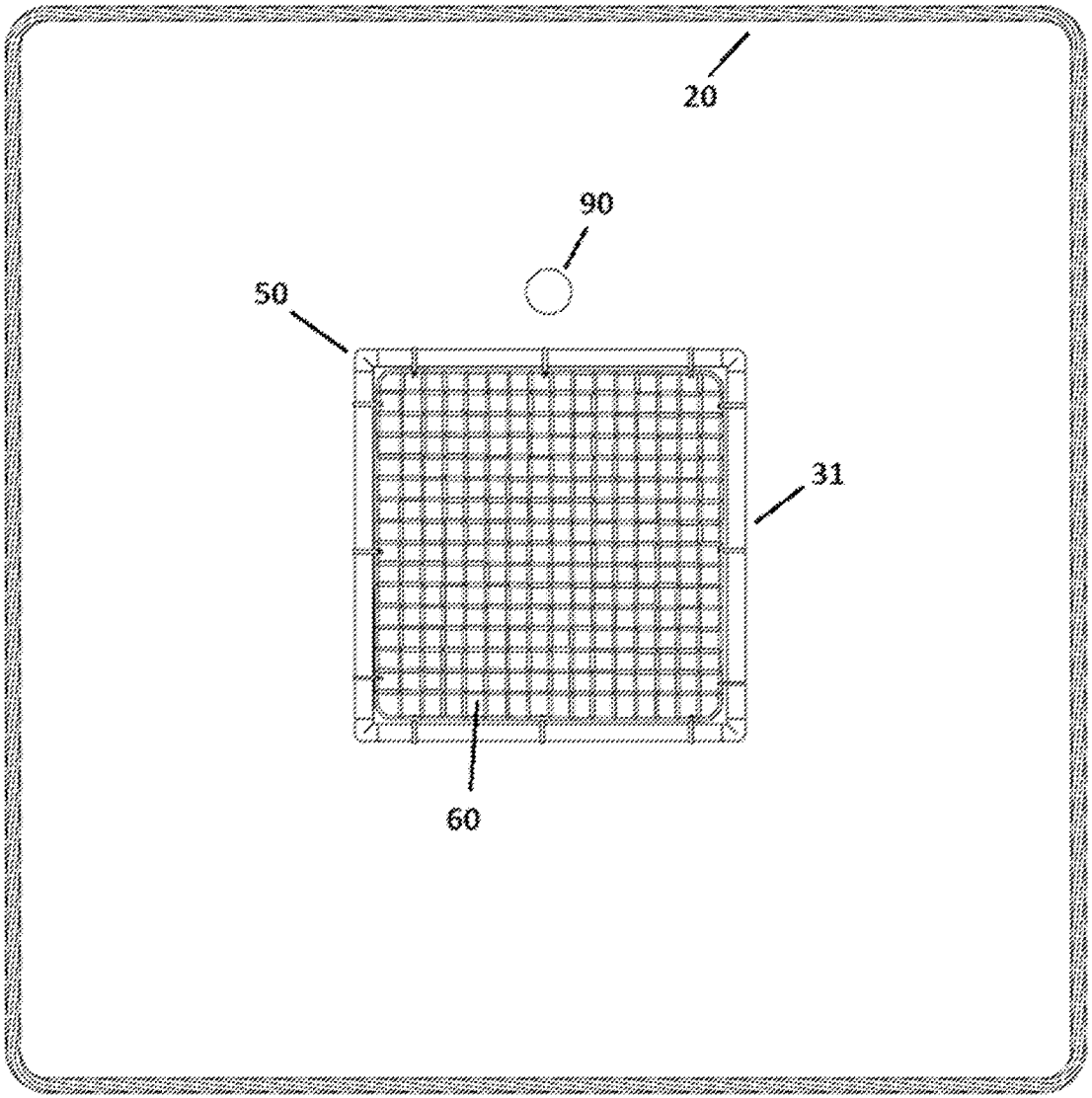
FIG. 2 illustrates a top plan view of an embodiment of a goal and an object, shown here as a ball, which can be used to play a game.

Referring now to FIG. 1, a goal 30 and a court perimeter 20 for playing a ball game 1 are provided. The ball game 1 can be played with a four, five, six, or more sided goal that is placed with one side supported on a surface. In one embodiment, the game is played with a cubic shaped goal 30, which has at least one generally flat surface 60, a plurality of goal edges 40, and a plurality of goal edge connectors 50. There can be a court perimeter 20 that defines a space around the goal and a throwable object 90, such as, for example, a ball, as shown, for example, in FIG. 2.

Figure 15:
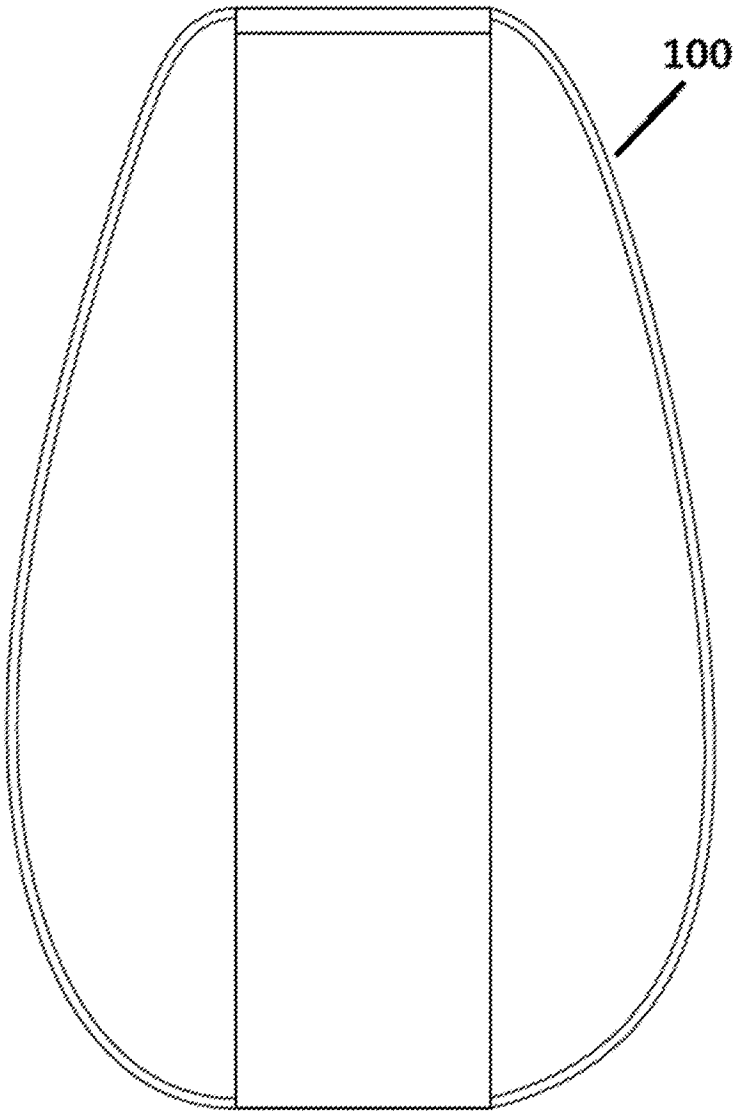
FIG. 15 illustrates a front elevation view of an embodiment of a bag in which a goal, according to the subject invention, can be stored.
Figure 16:
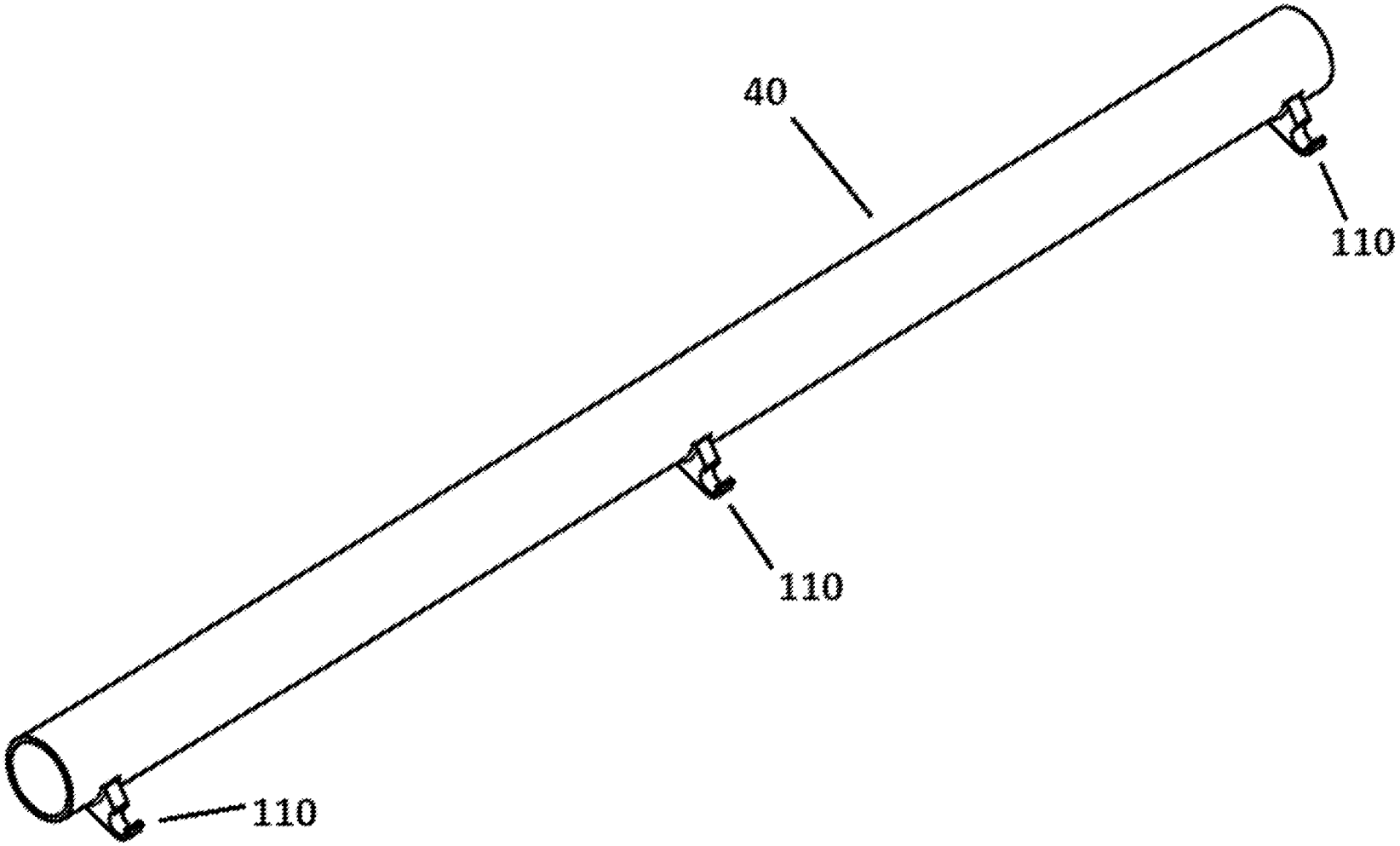
FIG. 16 illustrates a right-side perspective view of an alternative embodiment of an edge on a top side of a goal, according to the subject invention, which has a plurality of single hook portions.
Figure 17:
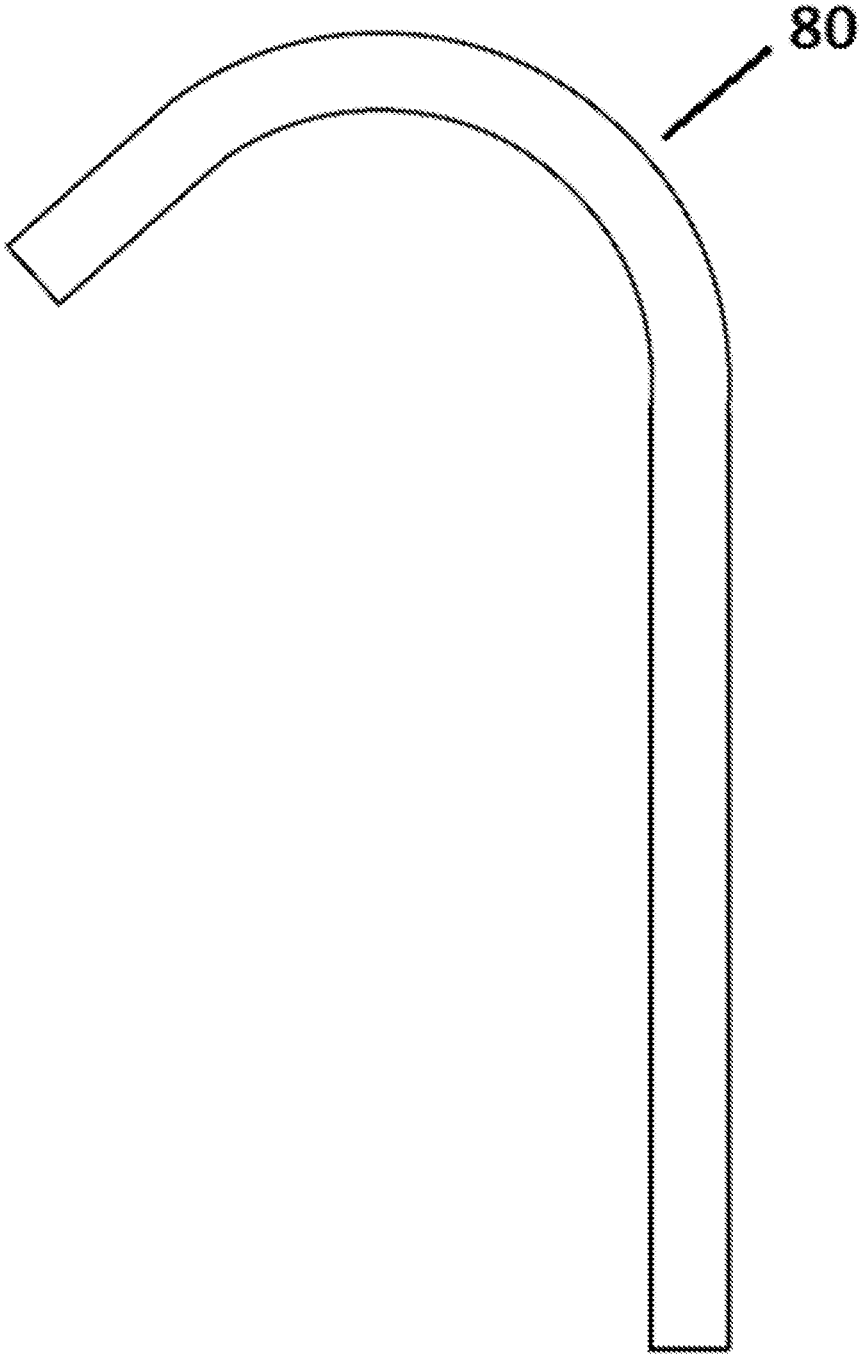
FIG. 17 illustrates a side elevation view of a stake used with an alternative embodiment of a goal, according to the subject invention, wherein a plurality of the stakes can be used for the court perimeter.
Figure 18:
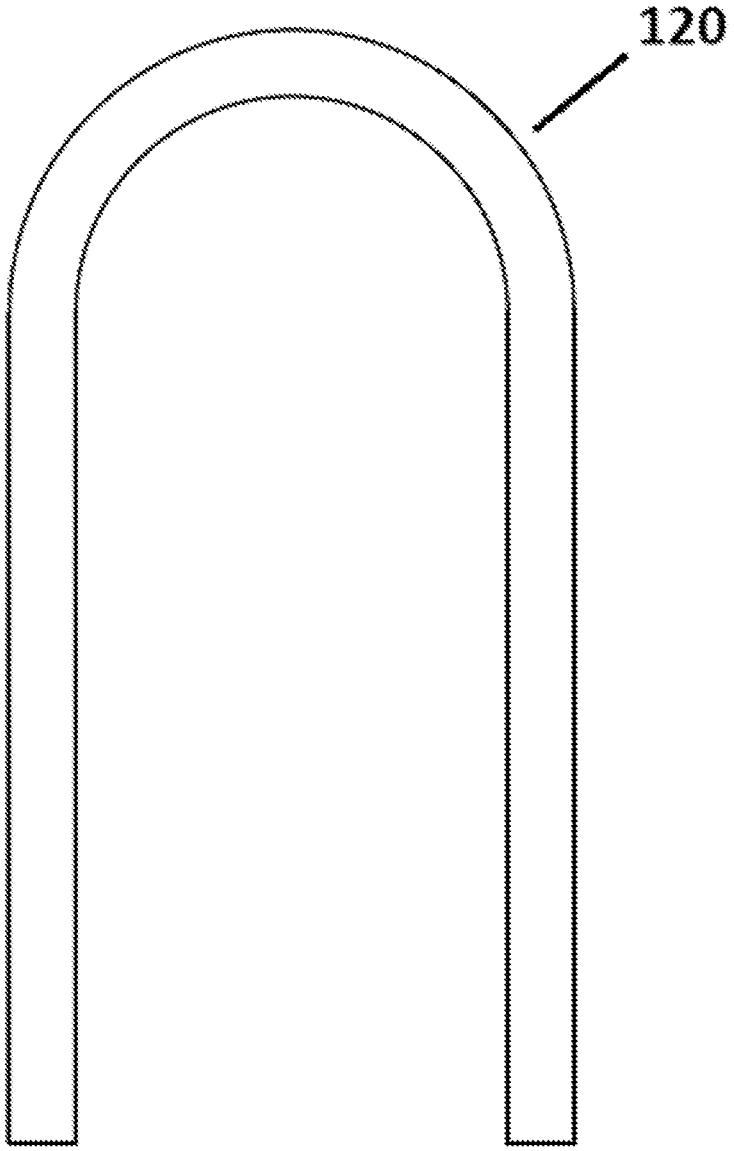
FIG. 18 illustrates a side elevation view of an alternative embodiment of a stake used with a goal, according to the subject invention, wherein a plurality of the stakes can be used for the goal edges.
Figure 19:
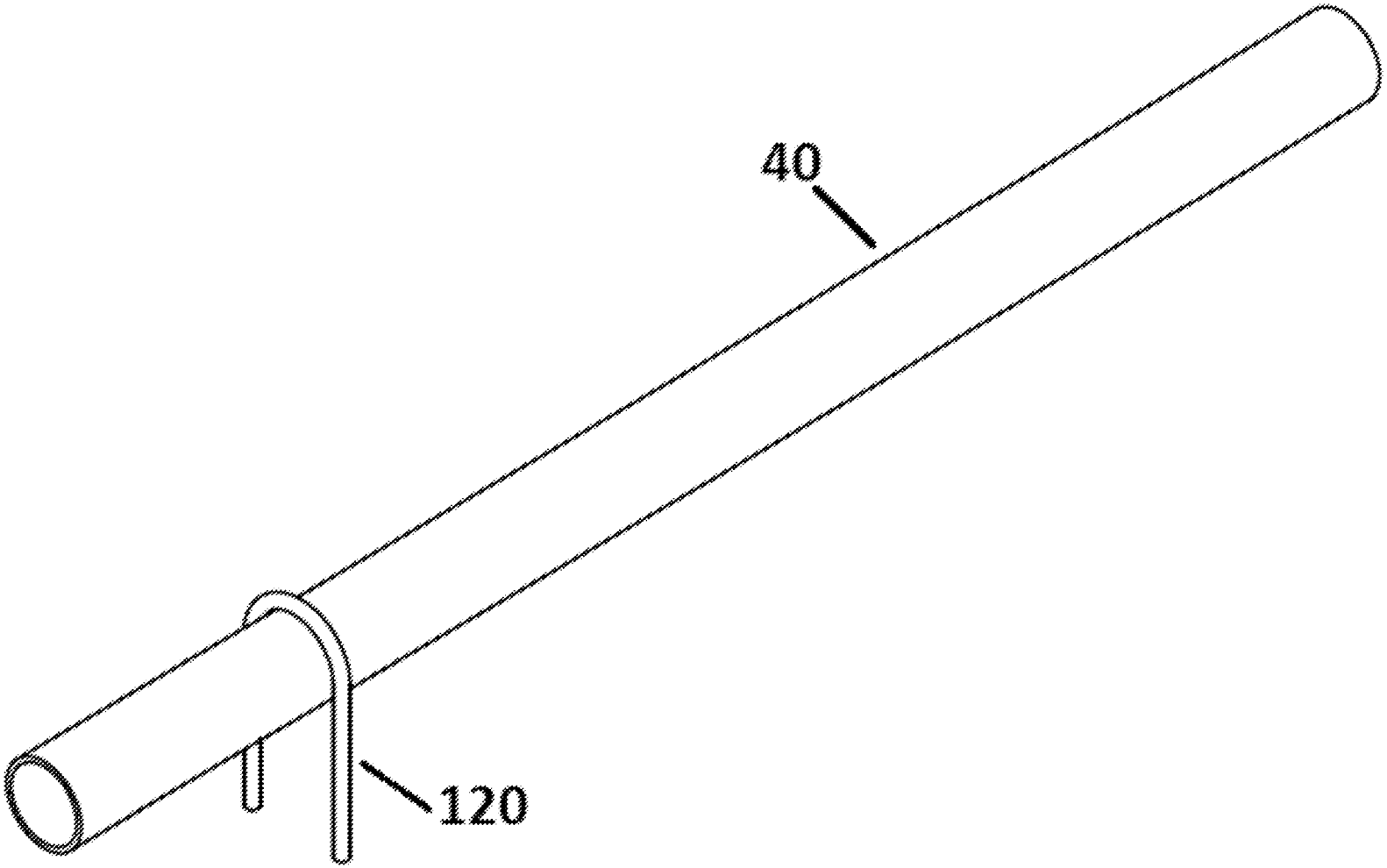
FIG. 19 illustrates the stake embodiment in FIG. 18 arranged on one of the plurality of edges of a bottom side of a goal, according to the subject invention.
Figure 20:
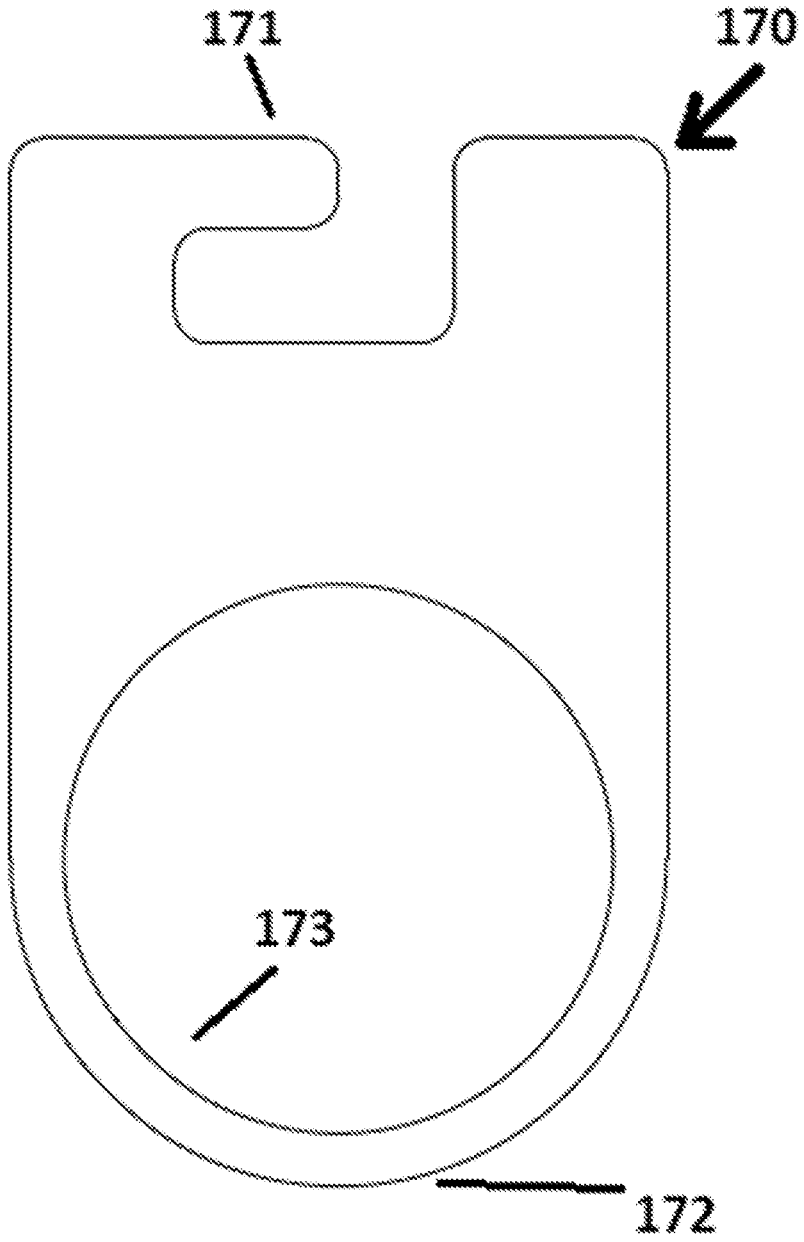
FIG. 20 illustrates a side elevation view of an alternative embodiment of a clamp with square end that can be utilized with a goal, according to the subject invention, for playing a game. Alternative embodiments can have variation in sizes.

In an embodiment, the goal 30 used to play the game 1 can be disassembled and transported in a carrying bag 100 (FIG. 15). The goal 30 can have a top side 31 and a bottom side 32.

Generally Flat Surface

Figure 26:
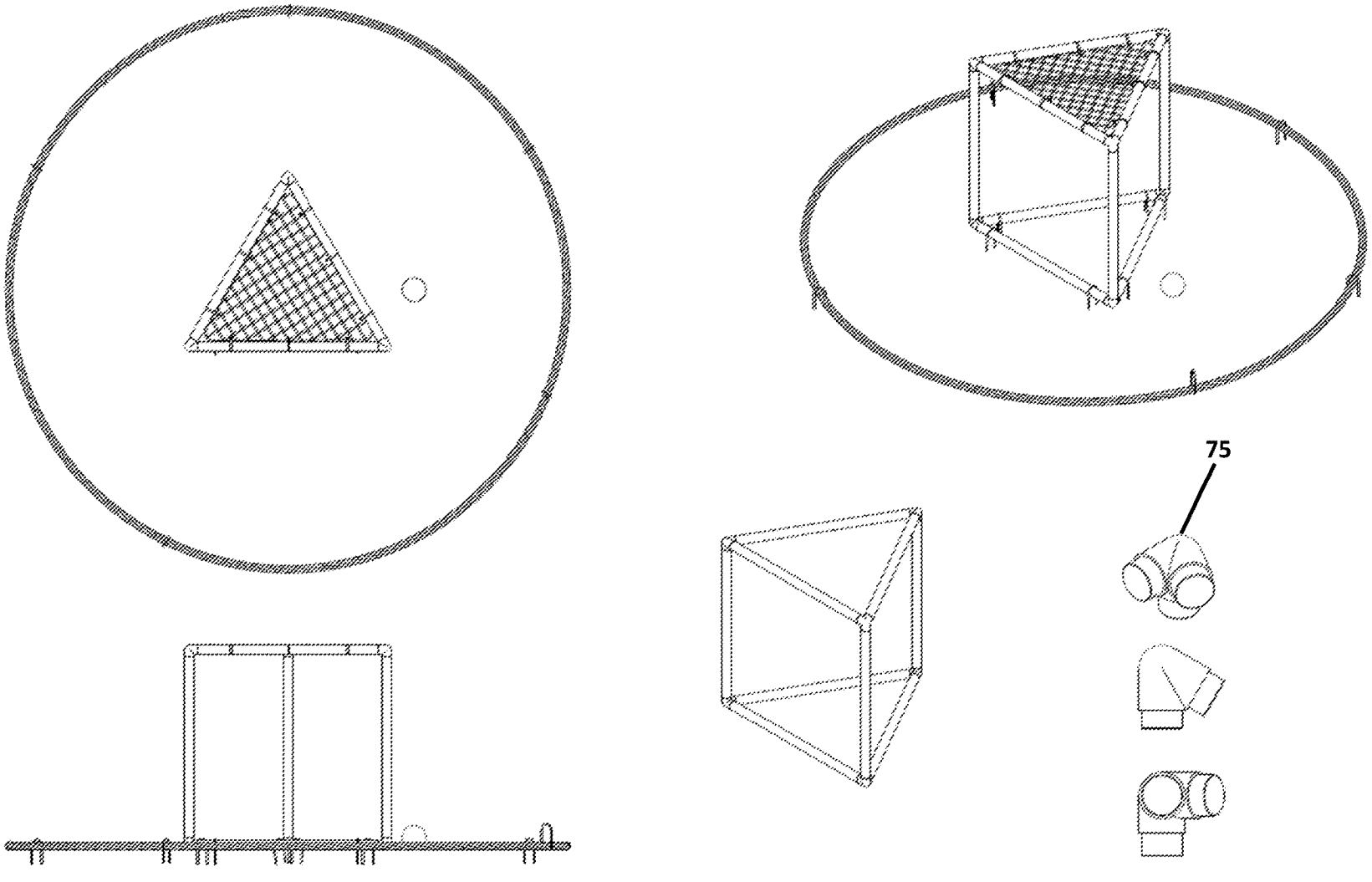
FIG. 26 illustrates a top view (upper left), a side view (bottom left), a front perspective view with a generally flat surface (upper right), a front perspective view of the assembled goal edges (center), and embodiments of connectors (bottom right) that can be utilized to assemble the goal edges of an alternative embodiment of a goal having a triangular prism shape, and a court perimeter having a circular shape.
Figure 27B:
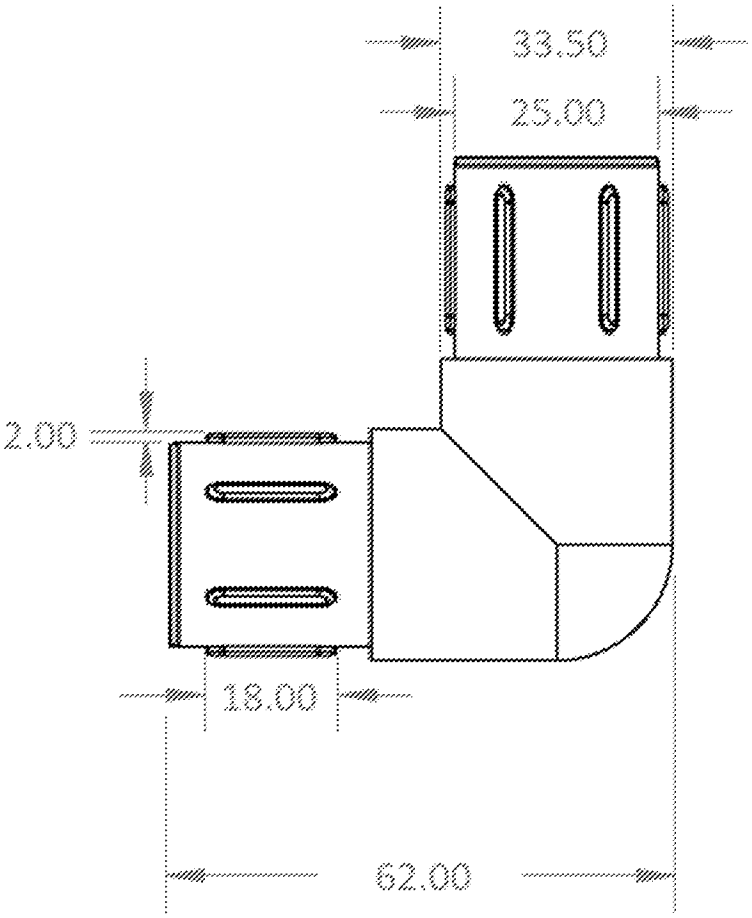
FIGS. 27A and 27B illustrate a top view and a side view, respectively, of a specific embodiment of an edge connector. The dimensions shown are in millimeters.
Figure 27A:
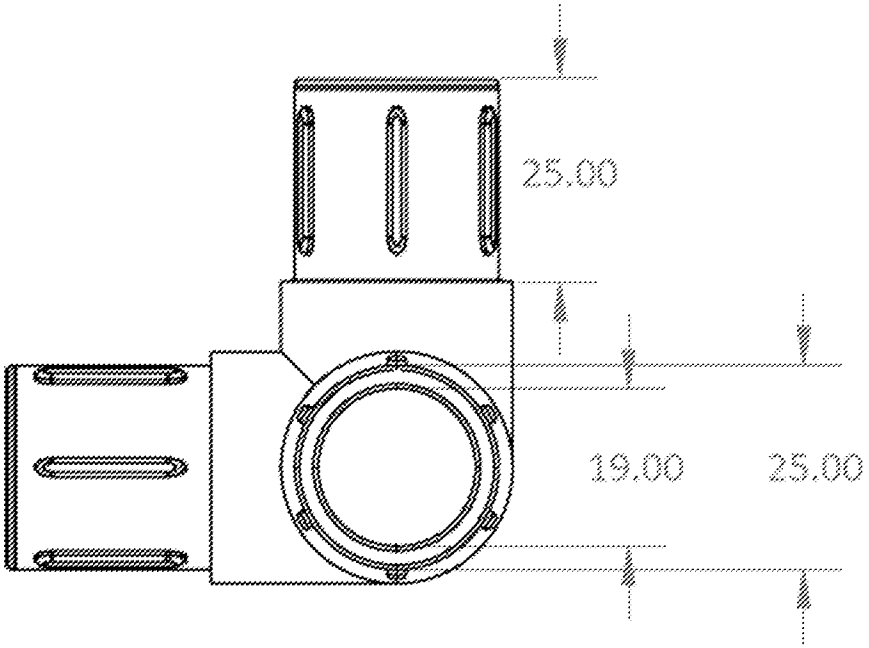

The generally flat surface 60 can form a barrier to inhibit the throwable object 90, such as a ball, from being thrown into the openings 35 of the goal. In one embodiment, the flat surface is made from an elastic material, such as, for example, elastic netting (as shown, for example, in FIGS. 1 and 26), an elastic woven fabric, or plastic tarp with or without pockets to attach the tarp onto the goal edges. In one embodiment, the generally flat surface 60 of the goal 30 is square. In another embodiment, the generally flat surface is triangular. The generally flat surface 60 can also have at least one side length 61. In one embodiment, the generally flat surface 60 is attached to a first side of the goal. In a further embodiment, the first side is the top side 31 of the goal 30.

Connecting Goal Edges

There can be a plurality of goal edge connectors 50 that can have lengths 54. The lengths can be joined at an elbow 75 and extend out to terminate in a first protruding part 51, a second protruding part 52, and a third protruding part 53, which is shown, for example, in FIG. 12. FIG. 11, FIG. 12, FIG. 13, FIG. 14, FIG. 21, FIG. 22, FIG. 23, FIG. 24, FIG. 25, and FIG. 26 show non-limiting examples of goal edge connectors that can be utilized to assemble a goal with four, five, six, or more sides. As the ordinary artisan can readily envision, other shapes of connectors can be used for creating polyhedron-shaped goals having more than six sides. Each length 54 of an edge connector, as shown, for example, in FIG. 11 and FIG. 12, can be generally cylindrical, can have a corner shaped shoulder 56, and can have ribbing 55 on the cylindrical protruding part. In an alternative embodiment, an edge connector can be devoid of the ribbing 55, as shown, for example, in FIG. 13 and FIG. 14. In one embodiment, a length can have a closed end or can be filled, such as shown, for example, in FIGS. 13 and 14. In the preferred embodiment, an edge connector is hollow 57, such that there is space within and through the lengths 54, as shown, for example, in FIG. 11 and FIG. 12. In an alternative embodiment, an edge connector can be solid throughout, such that the lengths are enclosed or filled therethrough, as shown, for example, in FIG. 13 and FIG. 14.

Figure 12:
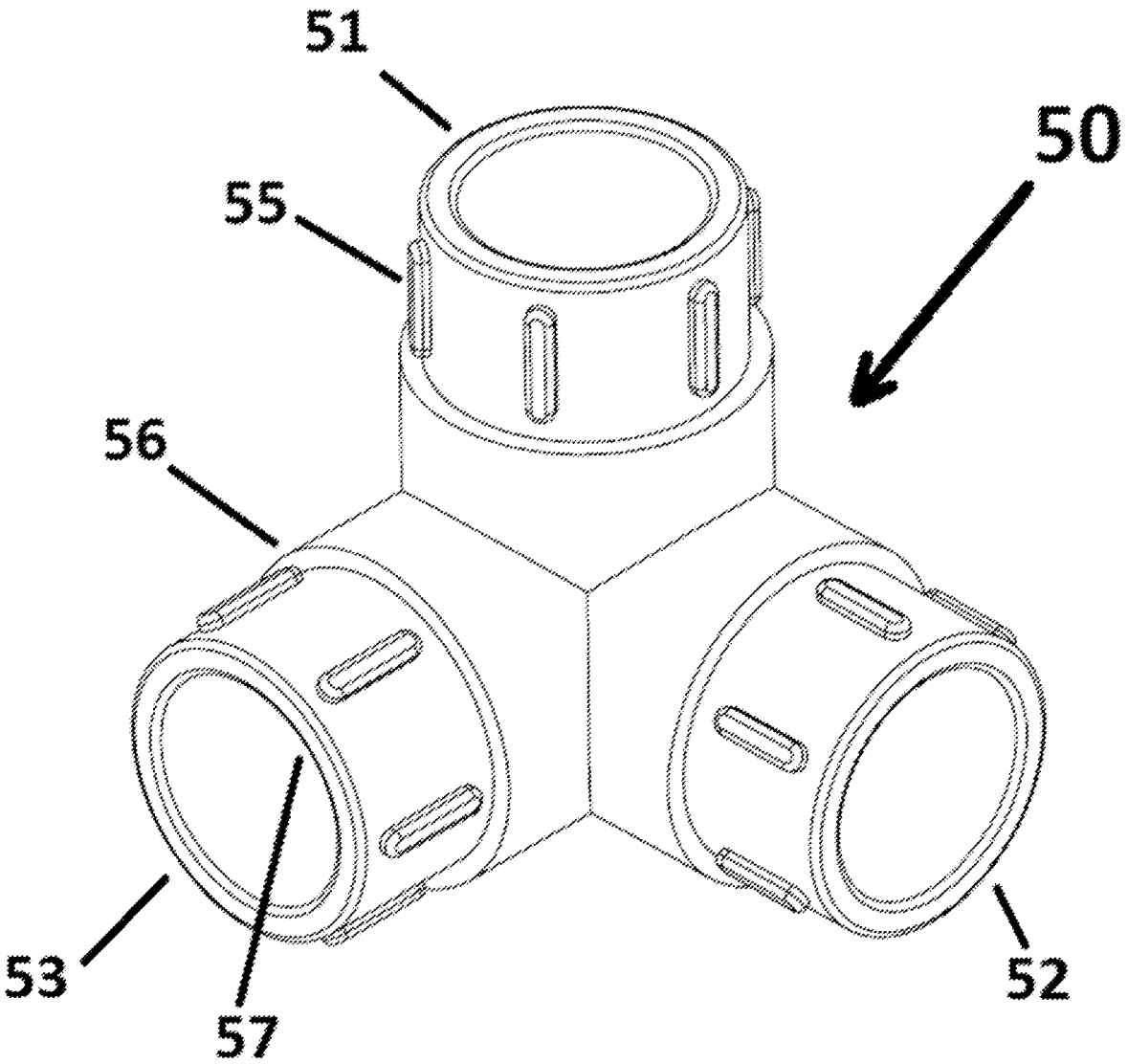
FIG. 12 illustrates a front perspective view of an edge connector that can be utilized with a goal, according to the subject invention.
Figure 13:
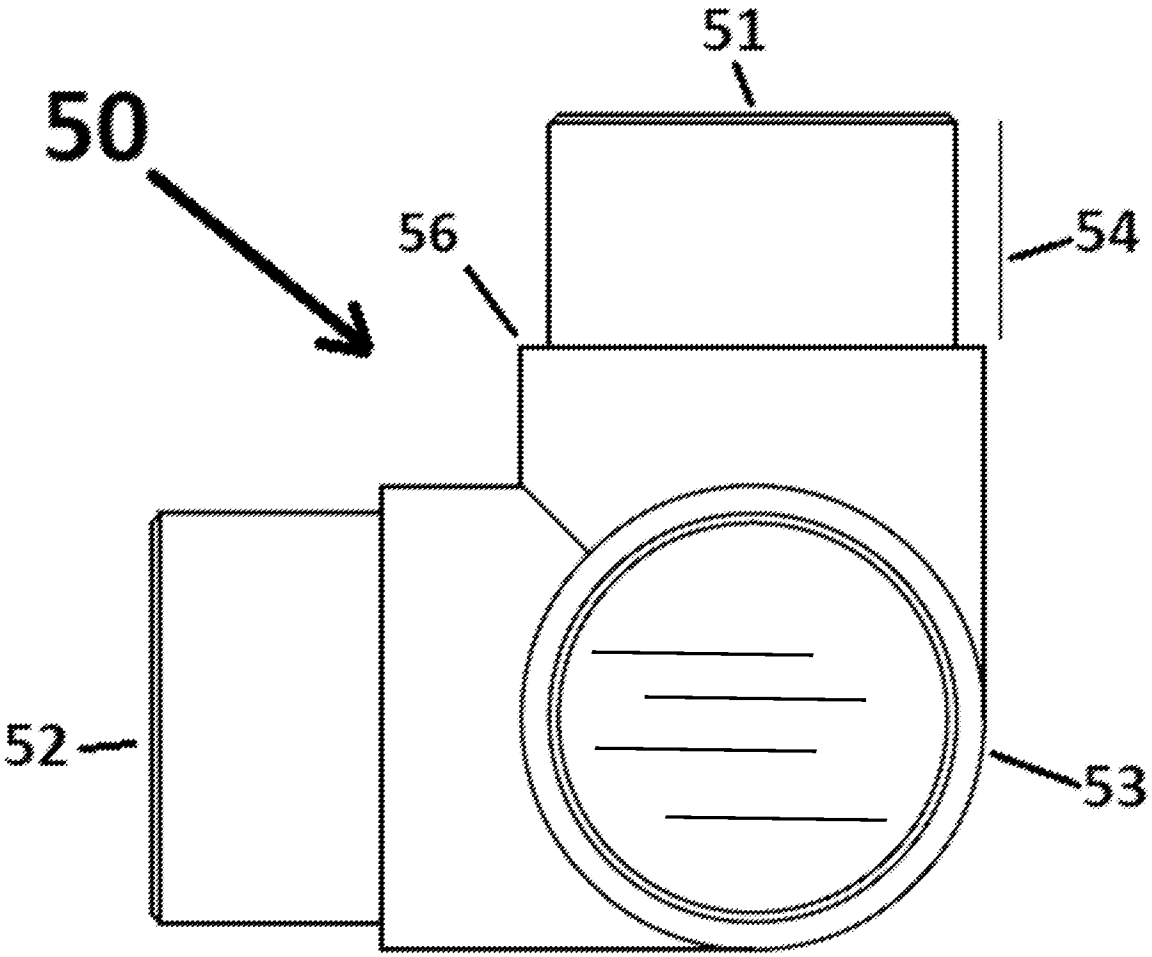
FIG. 13 illustrates a top plan view of an alternative embodiment of an edge connector without ribbing that can be utilized with a goal, according to the subject invention.
Figure 14:
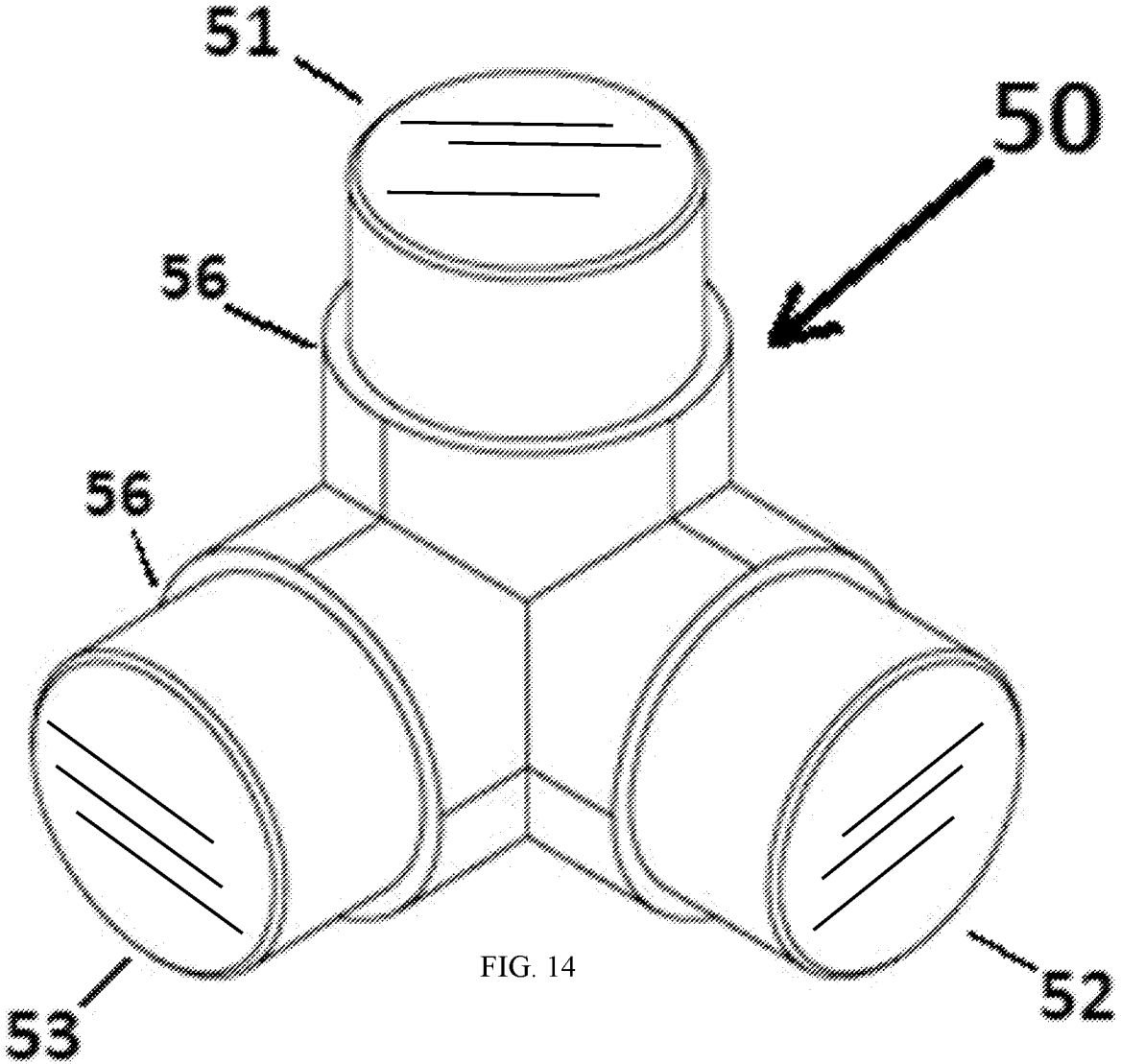
FIG. 14 illustrates a front perspective view of an alternative embodiment of an edge connector without ribbing that can be utilized with a goal, according to the subject invention.
Figure 21:
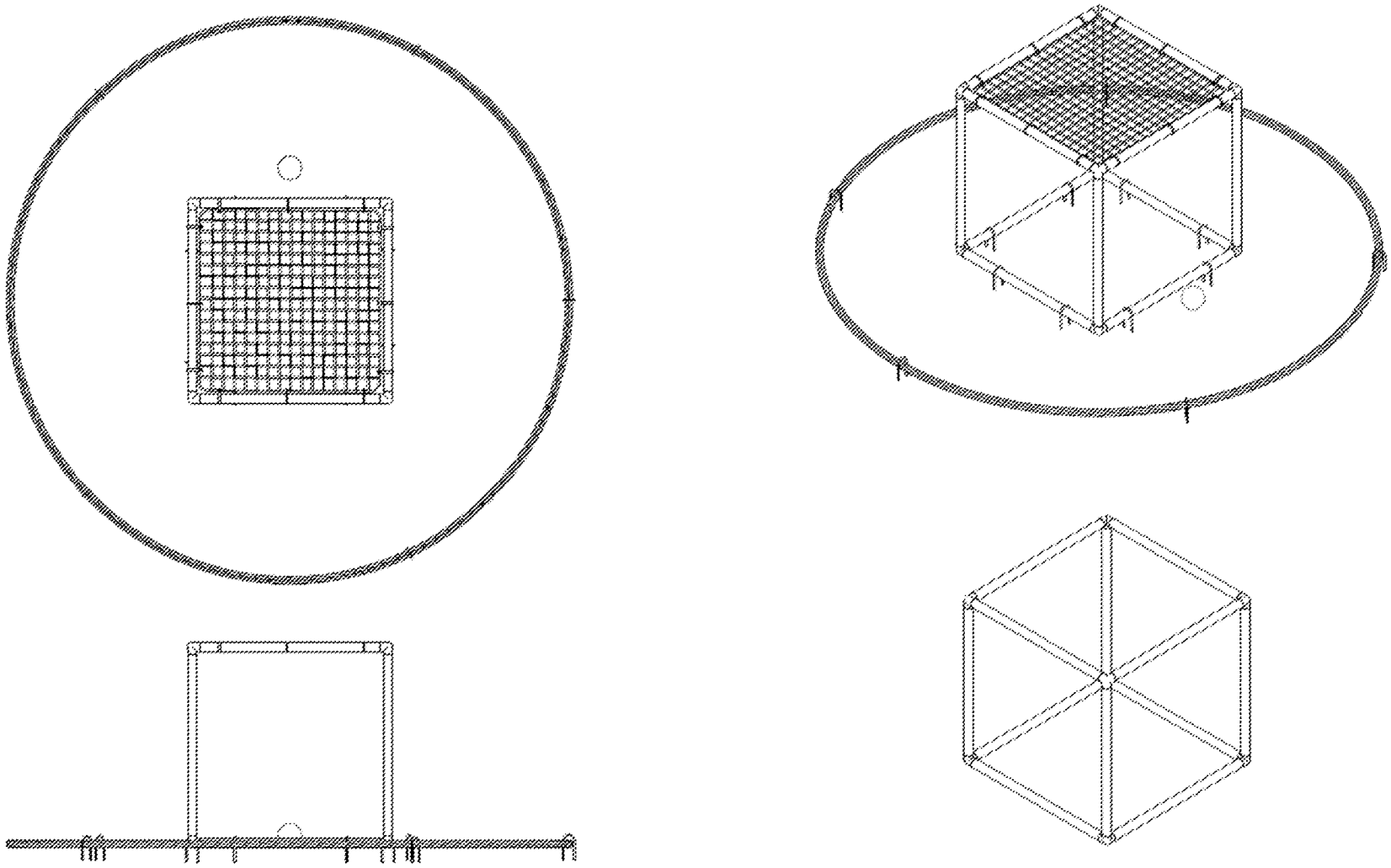
FIG. 21 illustrates a top view (upper left), a side view (bottom left), a front perspective view (upper right) of a goal with a generally flat surface, and front perspective view (bottom right) of the assembled goal edges of a goal, according to the subject invention, having a cubic shape, and a court perimeter that has a circular shape.
Figure 22:
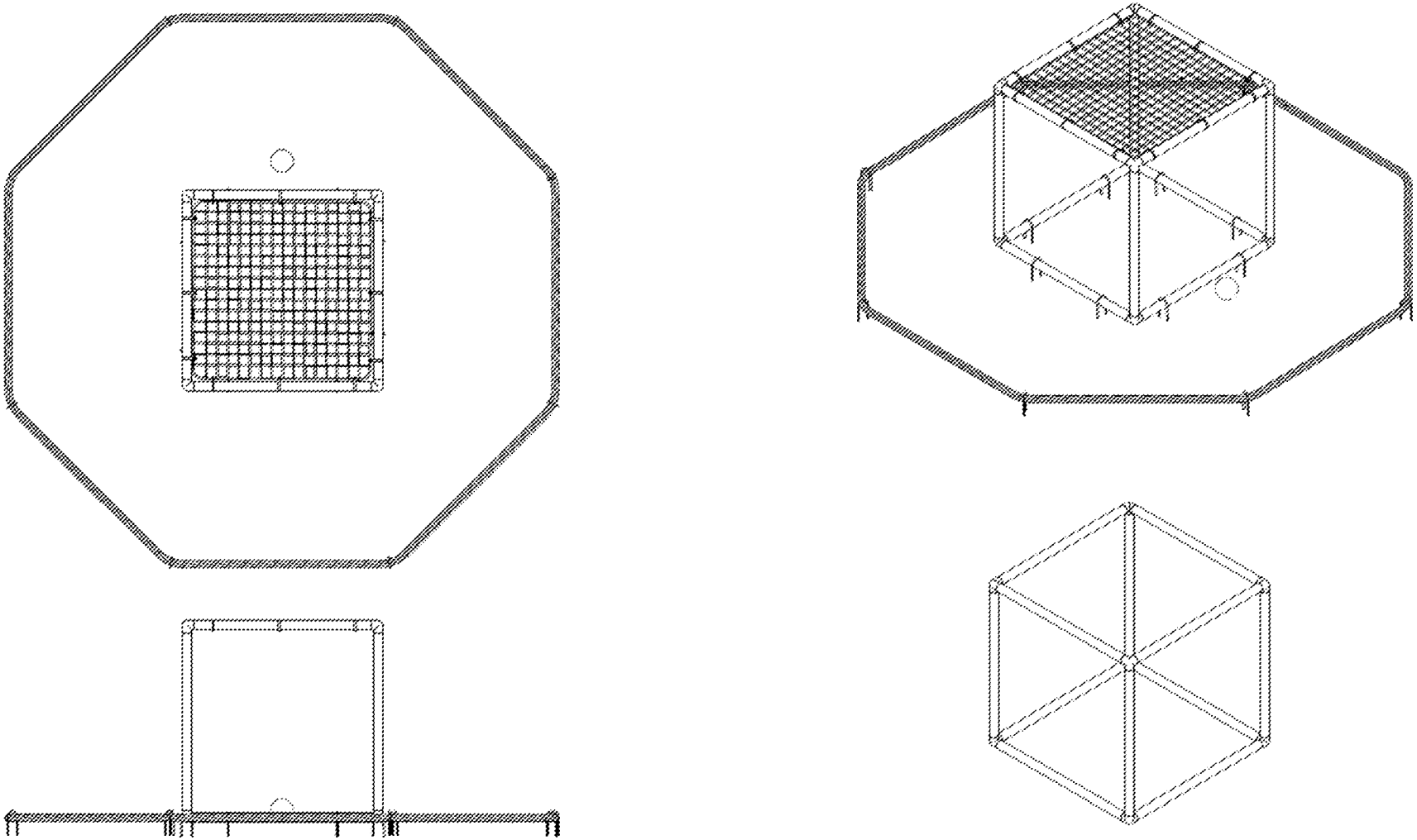
FIG. 22 illustrates a top view (upper left), a side view (bottom left), a front perspective view with a generally flat surface (upper right), and a front perspective view (bottom right) of the assembled goal edges of a goal, according to the subject invention, having a cubic shape, and an alternative embodiment of a court perimeter having an octagon shape.
Figure 23:
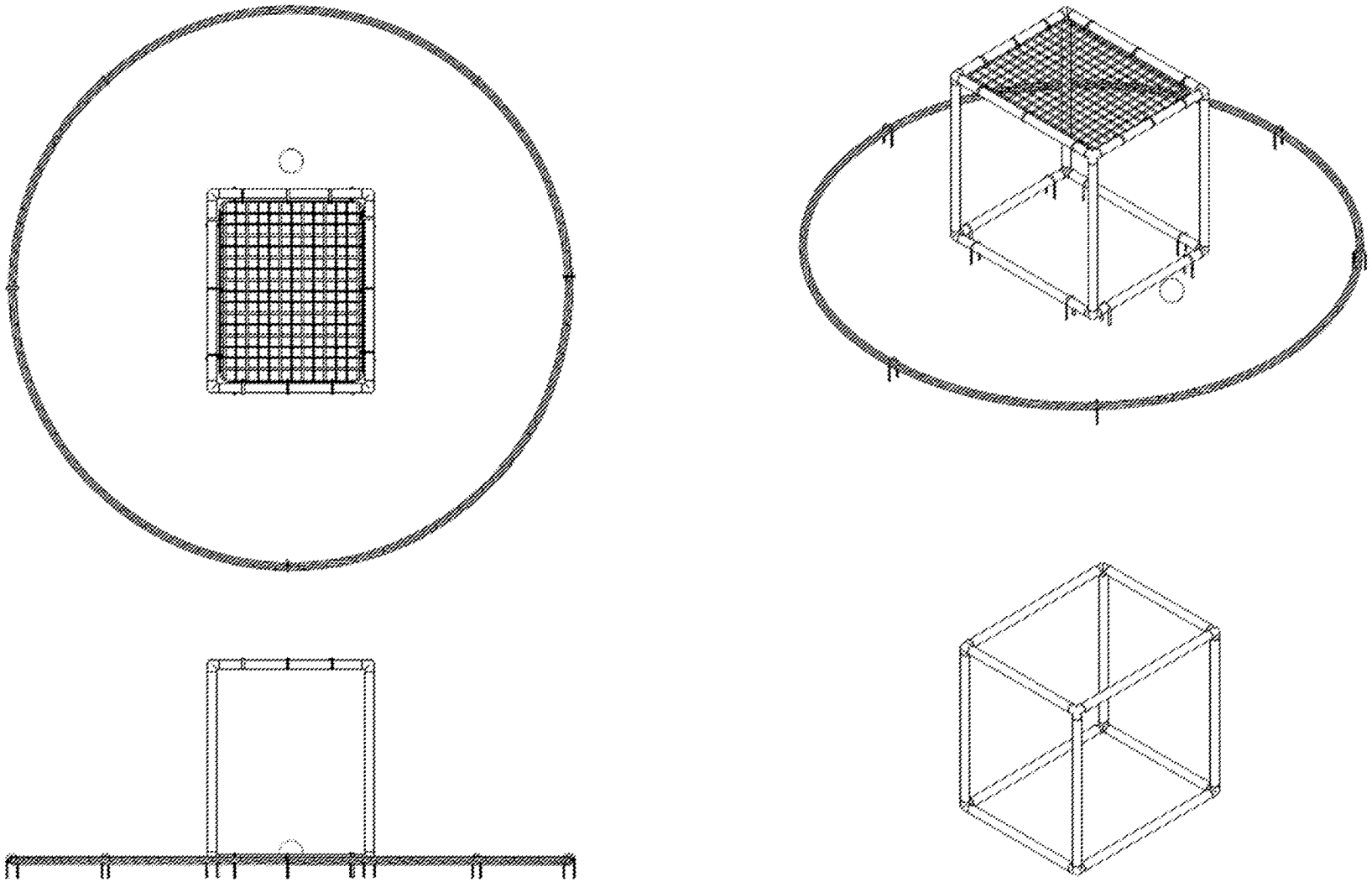
FIG. 23 illustrates a top view (upper left), a side view (bottom left), a front perspective view with a generally flat surface (upper right), and a front perspective view (bottom right) of the assembled goal edges of an alternative embodiment of a goal having a parallelepiped shape, and a court perimeter having a circular shape.
Figure 24:
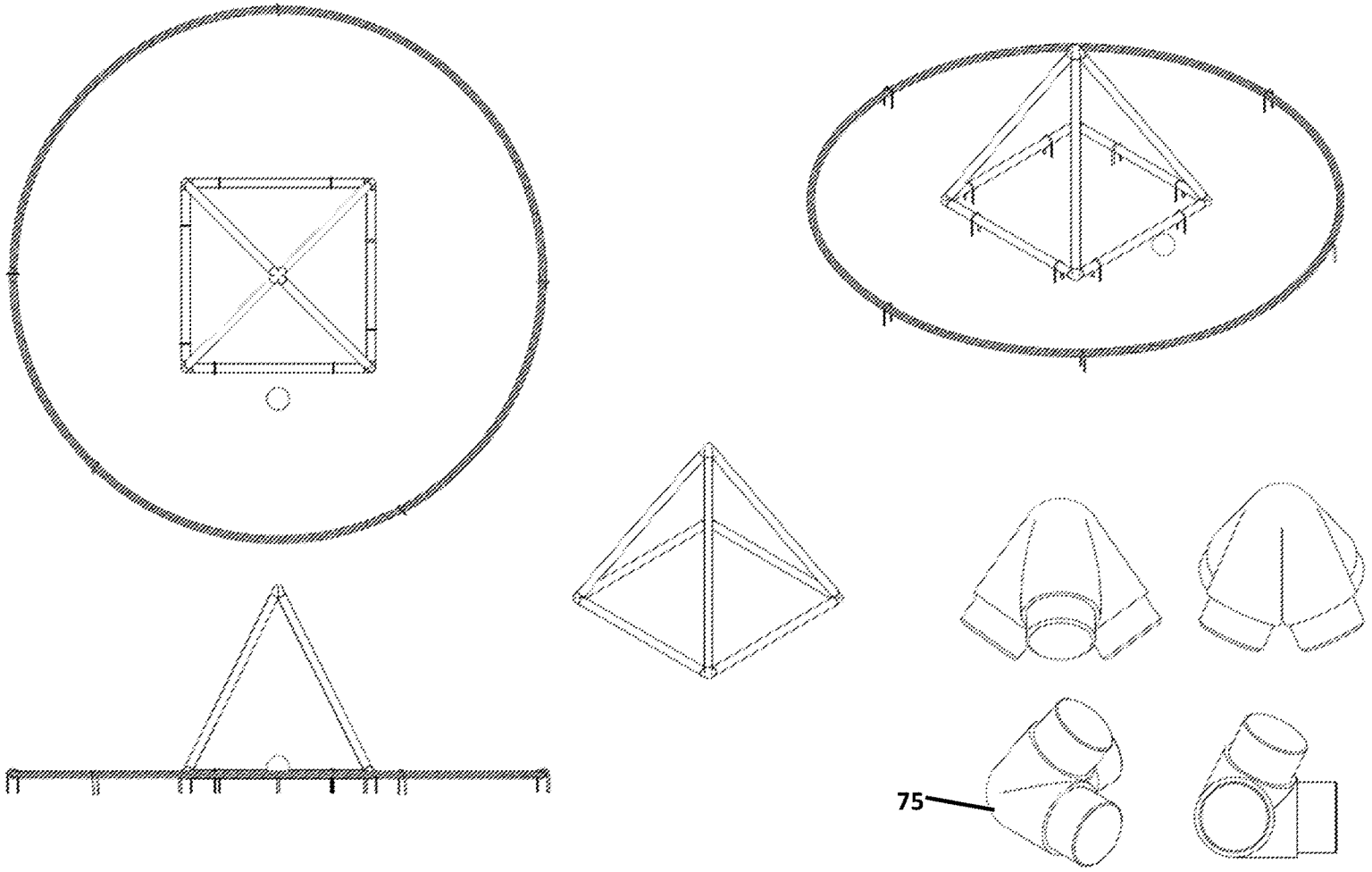
FIG. 24 illustrates a top view (upper left), a side view (bottom left), a front perspective view with a court perimeter (upper right), a front perspective view of the assembled goal edges (center), and embodiments of connectors (bottom right) that can be utilized to assemble the goal edges of an alternative embodiment of a goal, according to the subject invention, wherein the goal has a square base pyramid shape, and a court perimeter having a circular shape.
Figure 25:
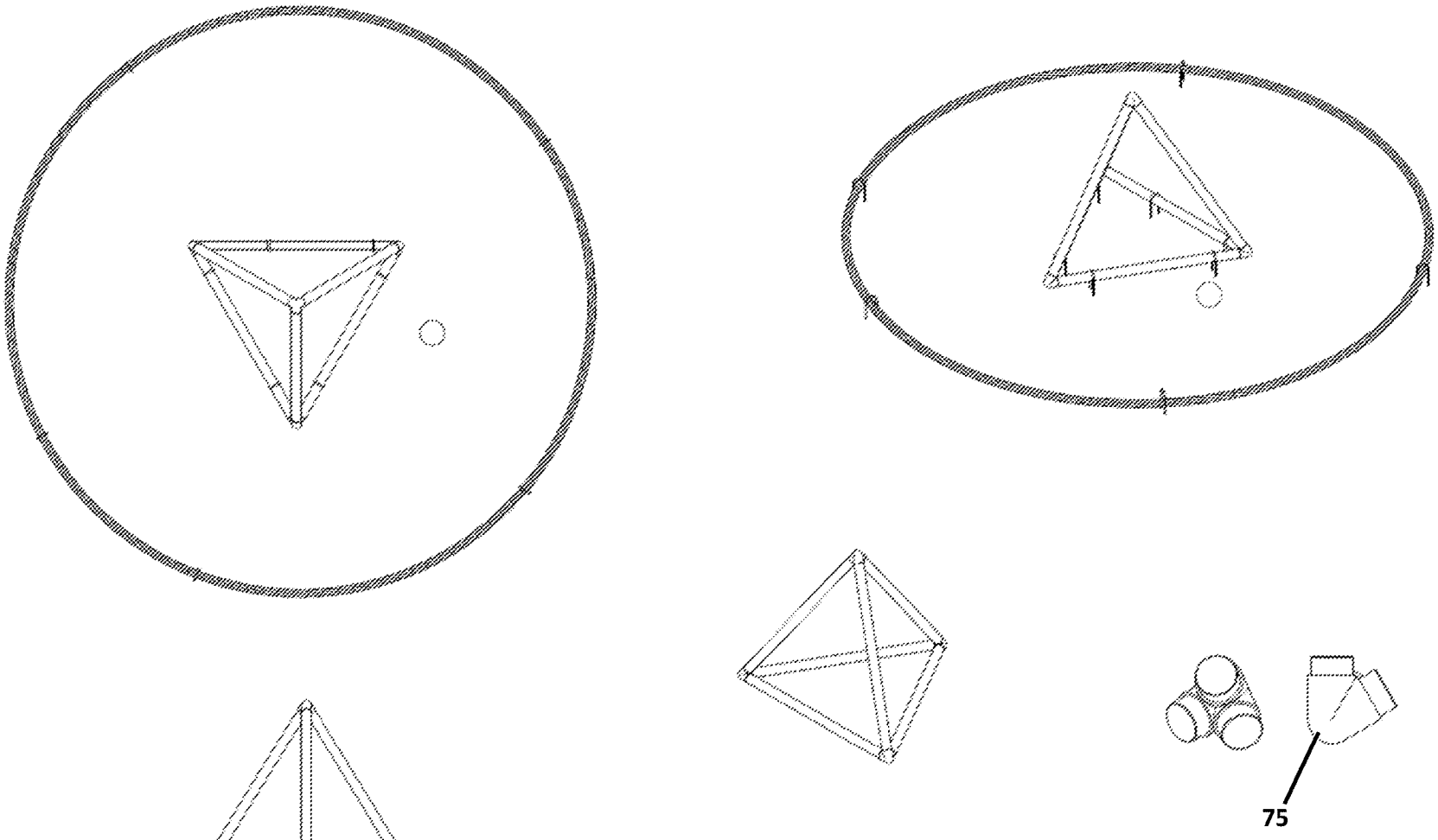
FIG. 25 illustrates a top view (upper left), a side view (bottom left), a front perspective view with a court perimeter (upper right), a front perspective view of the assembled goal edges (center), and embodiments of connectors (bottom right) that can be utilized to assemble the goal edges of an alternative embodiment of a goal having a triangular base pyramid shape, and a court perimeter having a circular shape.

In one embodiment, a goal edge connector has lengths that are arranged at 90° angles, such as shown, for example, in FIG. 12. With this embodiment, goal edges are engaged with the first protruding part 51, the second protruding part 52, and the third protruding part 53 of the lengths to form cube-shaped or rectangular-shaped goals. In an alternative embodiment, a goal edge connector has lengths that are arranged at 60° angles, such as shown in FIG. 24, bottom right. With this embodiment, goal edges are engaged with the first protruding part, the second protruding part, and the third protruding part to form a tetrahedron-shaped goal, such as shown in FIG. 21. In a further embodiment, a goal edge connector has four lengths, arranged at 60° angles. When goal edges are engaged with the protruding parts of each length, there is formed a pyramid-shaped goal. In yet another embodiment, a goal edge connector has lengths arranged at both 60° angles and 90° angles, such as shown, for example, in FIG. 26, bottom right. When goal edges are engaged with the protruding parts, a prism-shaped goal is possible.

Figure 3:
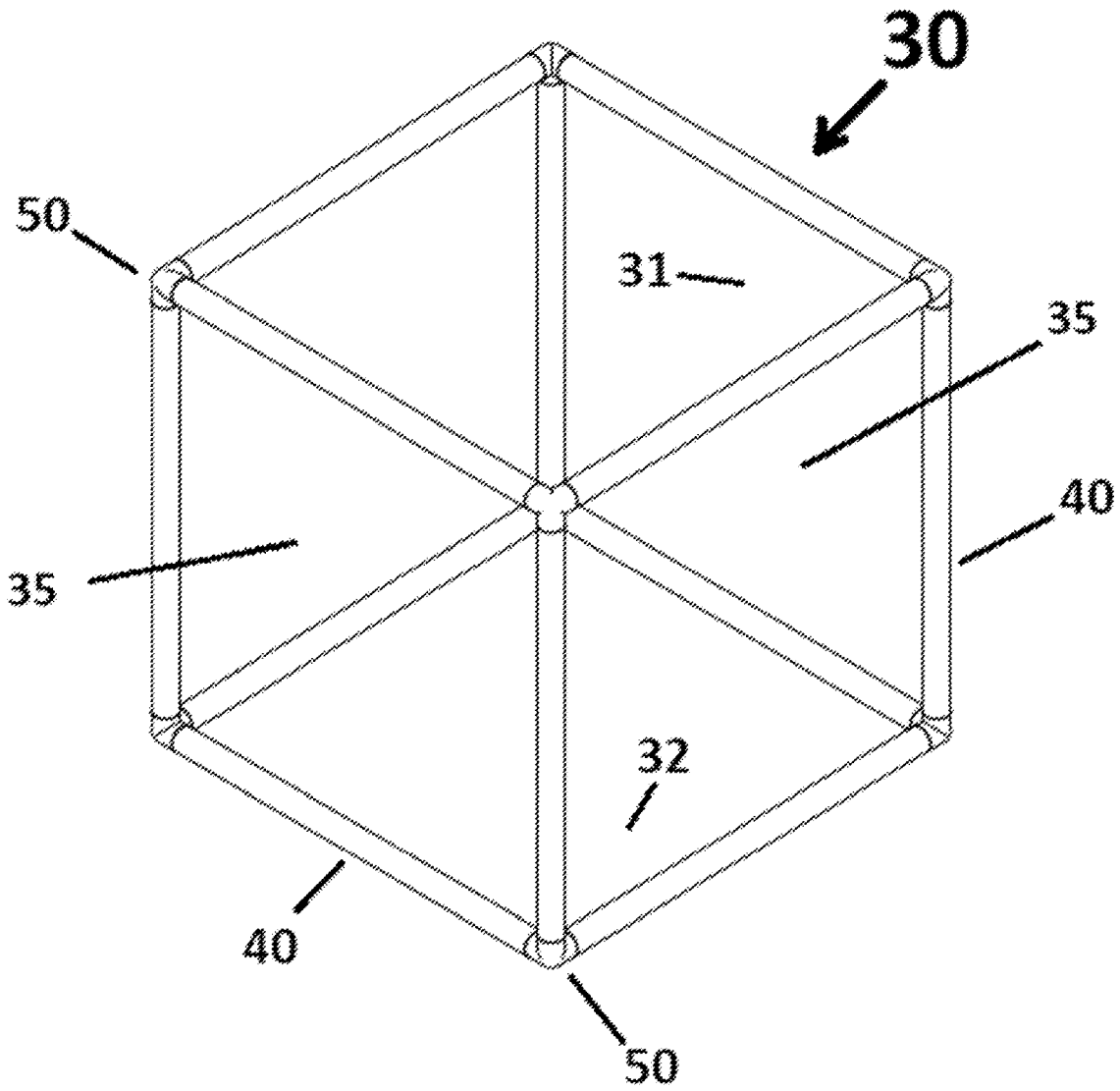
FIG. 3 illustrates a front right perspective view of an embodiment of a goal that can be used to play a game.
Figure 4:
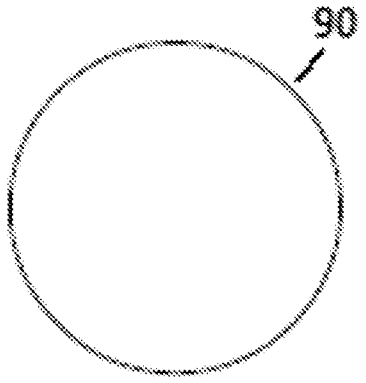
FIG. 4 illustrates a front elevation view of an object that can be used with embodiments of a goal, according to the subject invention, to play a game. The object as shown here is a round ball.
Figure 5:
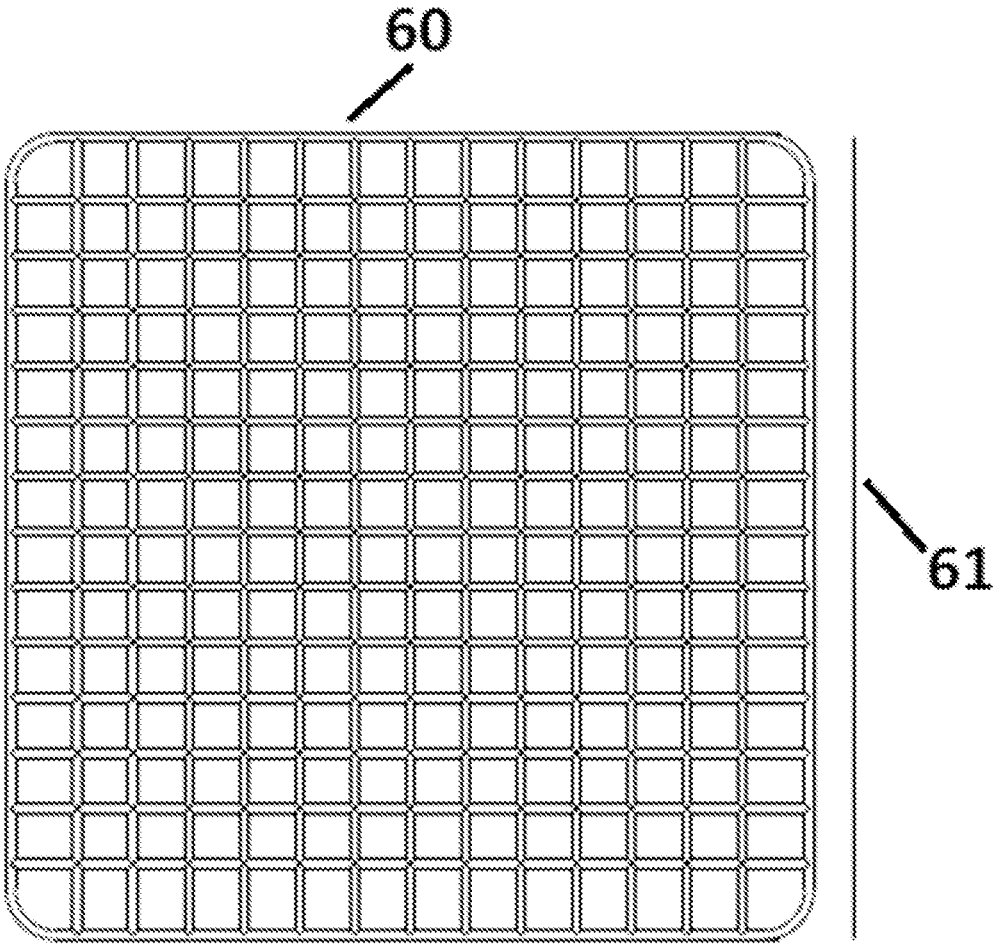
FIG. 5 illustrates a top plan view of an embodiment of a generally flat surface of a goal that can be used to play a game.
Figure 8:
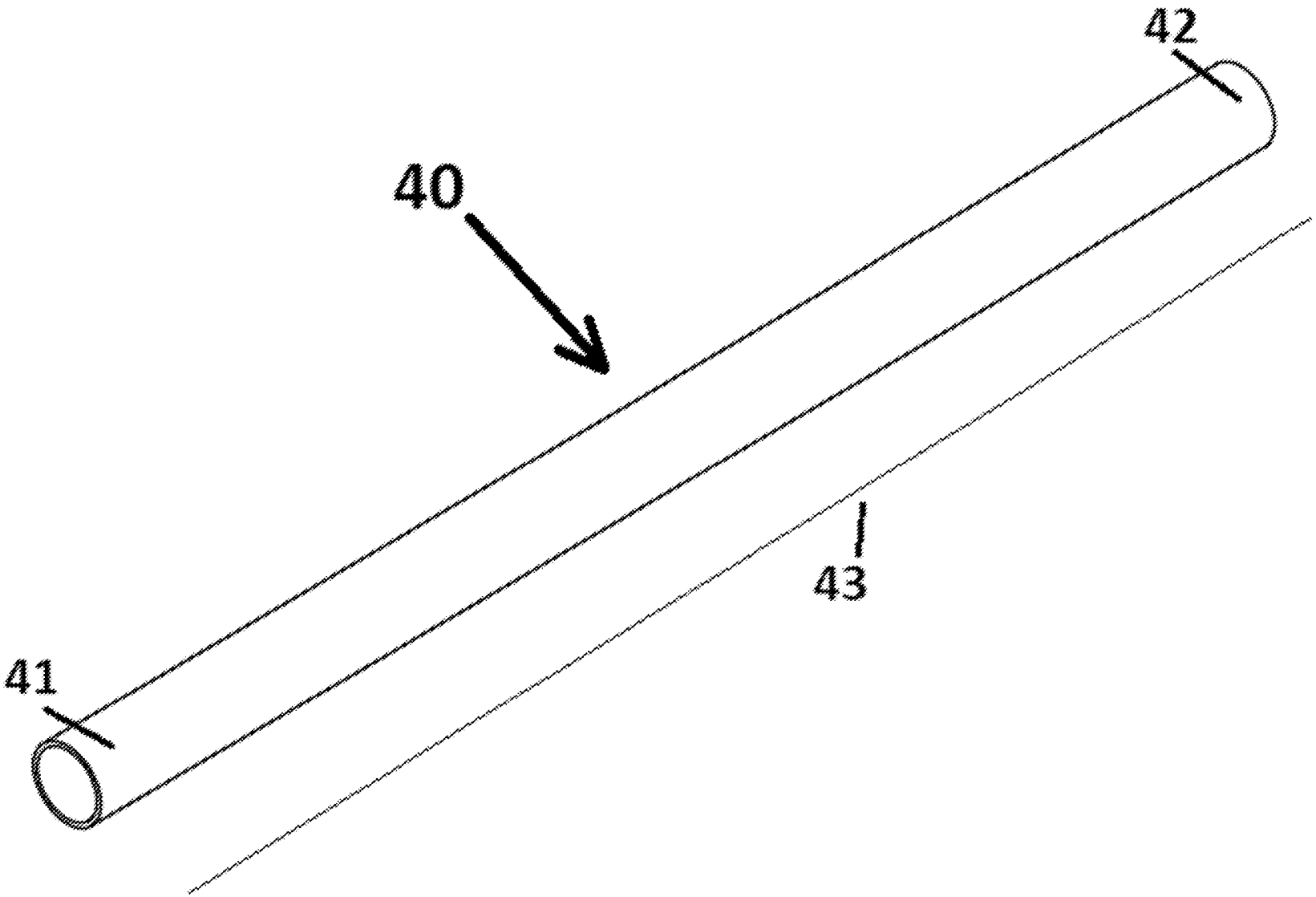
FIG. 8 illustrates a right-side perspective view of an embodiment of an edge of a goal, according to the subject invention, used to play a game.
Figure 9:
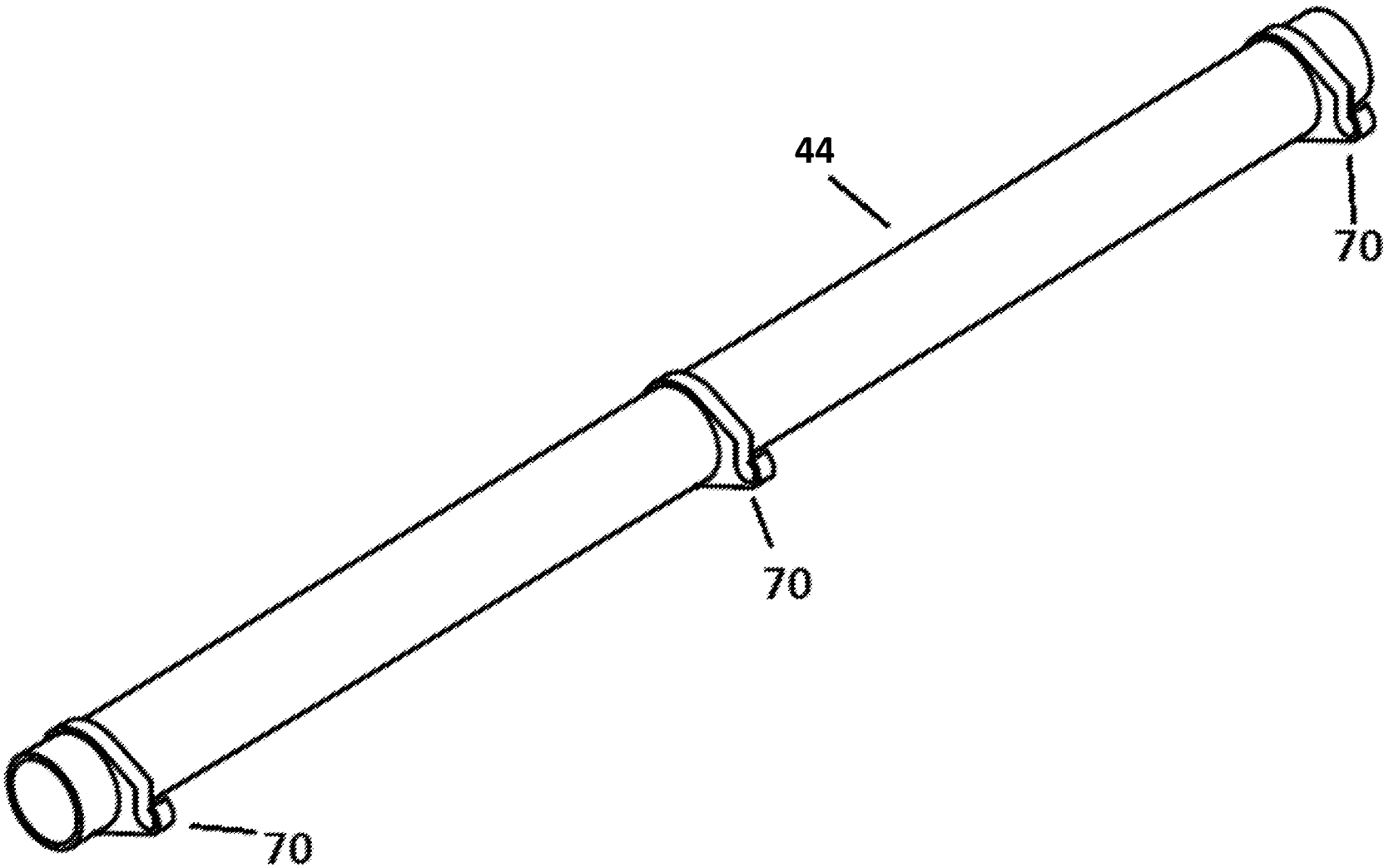
FIG. 9 illustrates a right-side perspective view of an embodiment of an edge of a goal, according to the subject invention. The edge is shown with three clamps attached thereto.
Figure 10:
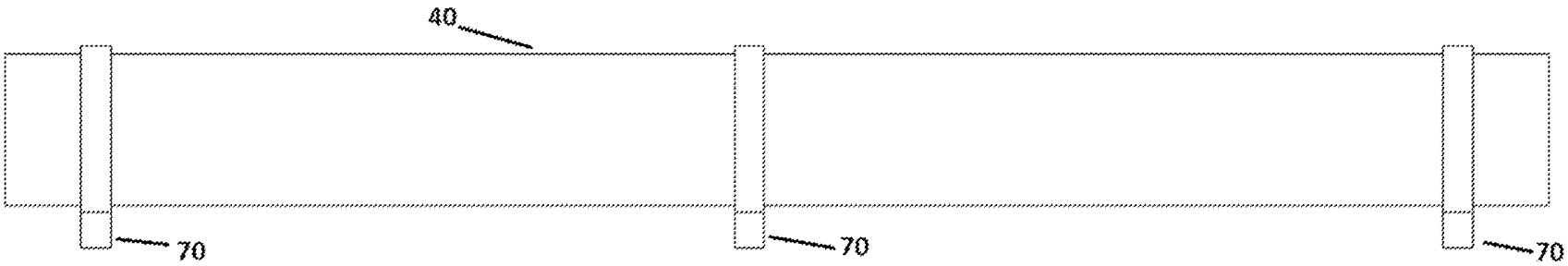
FIG. 10 illustrates a top plan view of the edge of the goal shown in FIG. 9.
Figure 11:
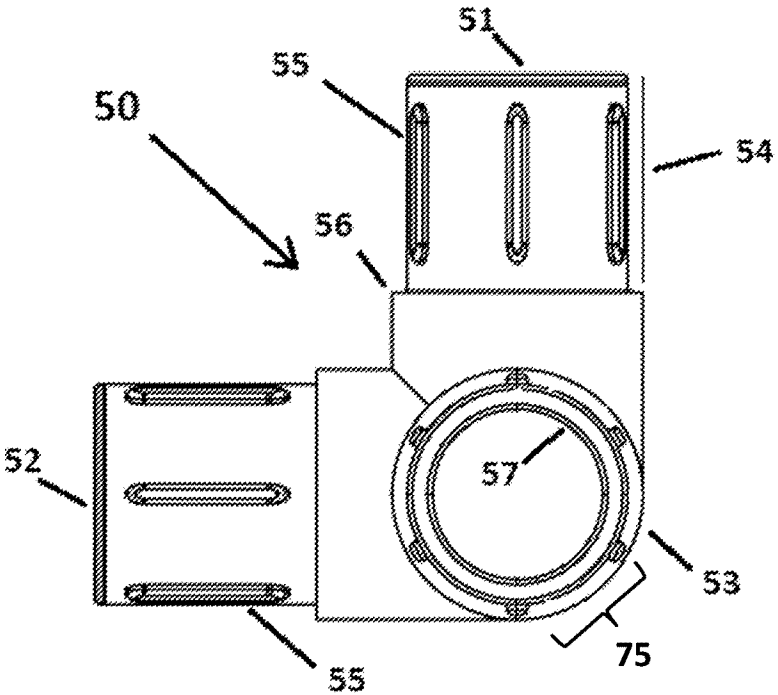
FIG. 11 illustrates a top plan view of an embodiment of an edge connector that can be utilized with a goal, according to the subject invention.

There can also be a plurality of goal edges 40 that have a first end 41, a second end 42, and a length 43 therebetween, an example of which can be seen in FIG. 8. In one embodiment, a goal edge is generally cylindrical and has a straight length. In another embodiment, a goal edge can be tubular. The first end 41 of the goal edges 40 can connect to at least one of the first protruding part 51, the second protruding part 52, and the third protruding part 53 of a goal edge connector 50. The ends 41, 42 of the goal edges 40 may be removably secured to the protruding parts of the goal edge connectors 50. By way of non-limiting example, at least one of the first end and the second end of a goal edge can be secured by a friction fit to at least one of the first protruding part 51, the second protruding part 52, and the third protruding part 53 of a goal edge connector 50. The ribbing 55 advantageously improves the friction fit between the edge connectors 50 and the goal edges 40. In an alternative embodiment the goal edges 40 and the edge connectors 50 can have screw threads, which is not shown in the figures, but would be readily understood by the skilled artisan. Although any number of goal edges 40 and any number of goal edge connectors 50 can be used, it can be advantageous for the resulting goal to be cubic shaped when assembled. The internal circumference of the top side 31 of the resulting cubic shape goal 30 can be slightly greater than the side length 61 of the generally flat surface 60, such that the generally flat surface 60, when fully extended, fits within the opening 35 formed on the top side 31 when the goal 30 is being assembled, as shown, for example, in FIG. 3.

Clamps

Figure 6:
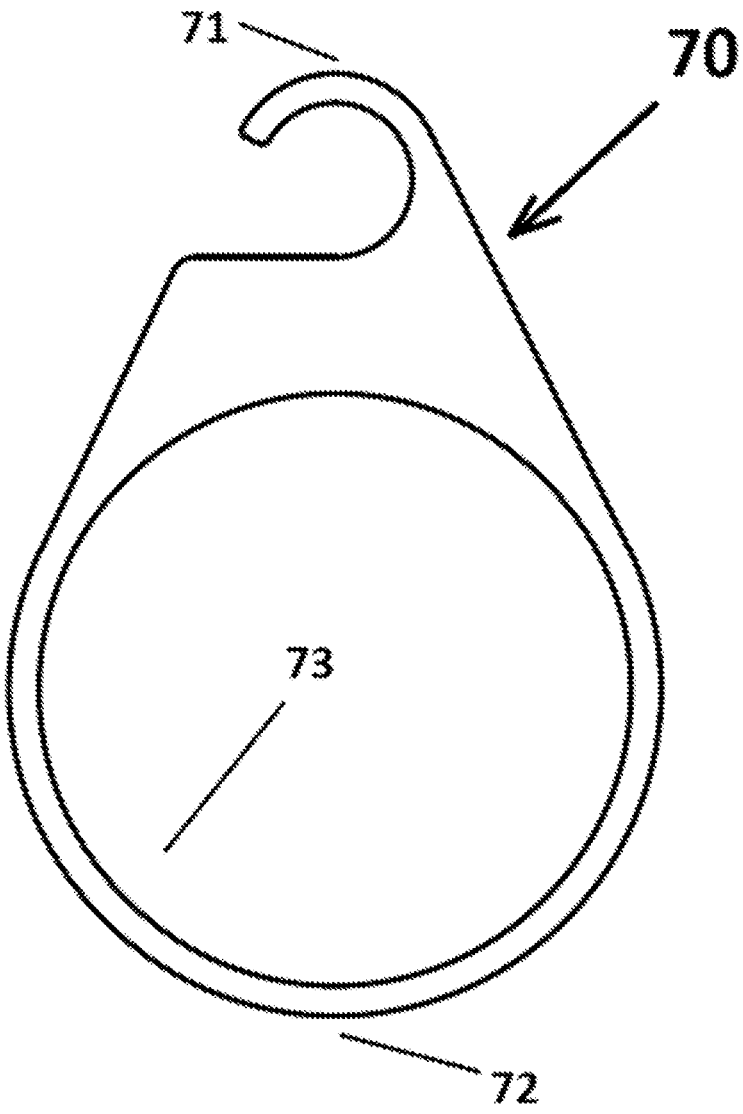
FIG. 6 illustrates a side elevation view of an embodiment of a clamp that can be utilized with a goal, according to the subject invention, for playing a game.
Figure 7:
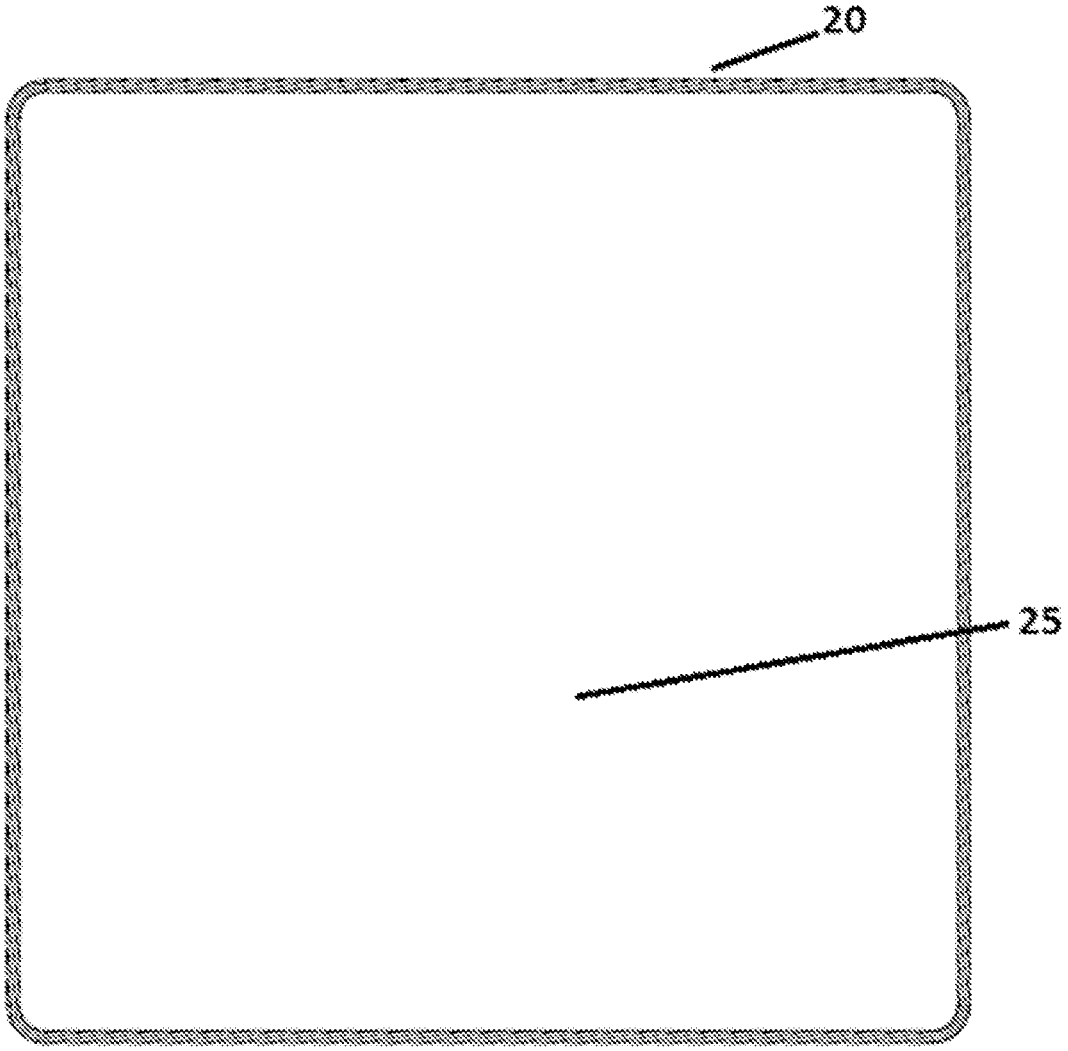
FIG. 7 illustrates a top plan view of one embodiment of a court perimeter in which embodiments of a goal, according to the subject invention, can be positioned to play a game.

Referring now to FIG. 6, a plurality of clamps 70 can be used to secure the generally flat surface 60 to the plurality of goal edges 40 that can form the top side 31 of the goal 30.

The clamps 70 can have a first end 71 and a second end 72. The clamps 70 can further have a generally circular opening 73 of a size that allows a portion of a goal edge 40 forming the top side 31 of the goal 30 to be inserted through. The clamp can also have a hook at the first end to which the generally flat surface engages. More specifically, to assemble the goal 30, the first end 41 or the second end 42 of a goal edge 40 for forming the top side 31 of the goal can be inserted through the opening 73 of a clamp 70. The generally flat surface can be engaged with the hook to form the top side of the goal.

Court Perimeter

The court perimeter 20 can have a length 21 utilized to define an area around a goal 30. The court perimeter 20 can have any shape, such as, for example, a circle, oval, square, other polygonal shape (convex or concave), or some combination thereof. In one embodiment, the court perimeter 20 forms an area that, when placed on a surface, can surround the goal 30 and two or more game players. In one embodiment, the court perimeter is a flexible cord, rope, string, or other elongated material that can be formed into any shape perimeter.

To Play the Game

To play the game, the goal 30 can be assembled by attaching the plurality of goal edges 40, the plurality of goal edge connectors 50, the plurality of clamps 70, and the general flat surface 60. To play the game, the court perimeter 20 is placed around the goal on a surface, such as the ground. The throwable object 90 is attempted to be thrown into the goal 30 by a player and an opposing player attempts to prevent the throwable object 90 from entering the goal 30.

Stakes

In a further embodiment, a plurality of stakes 80 can be arranged over the court perimeter 20 wherein the stakes 80 can be driven into the surface, such as the ground (e.g., sand), to inhibit shifting or movement of the court perimeter 20 position during use. In an alternative embodiment, a plurality of stakes 120 can be arranged over the plurality of goal edges 40 located on a bottom side 32 of the goal 30 wherein the stakes 120 are driven into the surface, such as the ground, to inhibit shifting or movement of the goal 30 position during use.

Goal Edges with Clamps Built in

In an alternative embodiment, the plurality of goal edges 40 forming the top side of the goal 30 can have a plurality of single hook portions 110 incorporated therewith. These hooked goal edges 44 can be operably connected to the generally flat surface to secure at least, a portion of the generally flat surface 60 in a manner similar to that of the clamp 70. Advantageously, the goal 30 can have increased durability and stability by utilizing the hooked goal edges forming the top side 31 of the goal 30 to secure the generally flat surface 60.

Preferred Sizes and Materials

In one embodiment, the assembled goal 30 has a cubic shape with the following dimensions: the width is about one meter, the length is about one meter, the height is about one meter. In a further embodiment, the throwing object 90 is a ball and in a still further embodiment, the ball has diameter of about 12 centimeters. In a yet further embodiment, the court perimeter 20 has a square shape where each side has length of about 3 meters, which defines a playing area 25 of about 9 square meters. The above-mentioned dimensions and shapes can be changed without departing from the spirit and scope of the invention.

There are any of a variety of materials and compositions that can be utilized for the embodiments of the subject invention, including, but not limited to, plastic, wood, metal, other materials, and combinations thereof. In one embodiment, the plurality of goal edges 40, the plurality of goal edge connectors 50, and the plurality of clamps 70 are manufactured from a polyvinyl chloride (PVC) material.

In one embodiment, the court perimeter 20 is manufactured from any type of natural fibers, for example, manila hemp, hemp, linen, cotton, coir, jute, straw, and sisal, or out of any type of synthetic fibers in use for ropemaking include polypropylene, nylon, polyesters, polyethylene, aramids, and acrylics. In a further embodiment, the court perimeter 20 is manufactured from polypropylene. Likewise, the stakes 80 utilized to secure the position of the court perimeter 20 can be manufactured from any of a variety of materials, including, but not limited to, metal, plastic, wood, other materials, and combinations thereof.

In one embodiment of the game device, the plurality of stakes 80 are manufactured from steel. The throwing object 90 can also be manufactured from any of a variety of materials, preferably, such materials have elasticity or "bounce".

In one embodiment, the throwing object is manufactured from polyvinyl chloride (PVC). The preferred embodiment, the throwing object is a ball made out of polyvinyl chloride.

ALTERNATIVE EMBODIMENTS

Although embodiments of the invention are shown and described herein, it should be understood that various changes and modifications to the presently preferred embodiments will be apparent to those skilled in the art. Such changes and modifications may be made without departing from the spirit and scope of the invention and without diminishing its attendant advantages.

Referring to FIG. 23, FIG. 24, FIG. 25, and FIG. 26, it can be seen that a goal 30 can have different shapes and/or dimensions. In one embodiment, the goal 30 has a shape of any polyhedron. For example, a goal can have the shape of a pyramid or a prism, where the bottom side 32 has a shape that is at least one of a square, a rectangle, a triangle, a pentagon, a hexagon, a heptagon, and an octagon.

Referring to FIG. 21, FIG. 22, FIG. 23, FIG. 24, FIG. 25, and FIG. 26, in an alternative embodiment of the game, the court perimeter 20 has different shape and/or sizes.

In an alternative embodiment of the game, various combinations of shapes of the goal 30 and of shapes of the court perimeter 20 are used. In an alternative embodiment of the game, various combinations of sizes of the goal 30 and of sizes of the court perimeter 20 are used.

The invention claimed is:

1. A game device, configured for playing a game, comprising:

a goal consisting of:

a plurality of goal edges; and a plurality of goal edge connectors;

a plurality of clamps comprising a circular opening for receiving at least one of the plurality of goal edges and a hook portion; and a generally flat surface that operably connects to the hook portion of at least one of the plurality of clamps;

wherein the plurality of goal edges, when assembled with the plurality of goal edge connectors, form a goal having a polyhedron shape and wherein, when the plurality of clamps is operably connected to at least one of the plurality of goal edges forming a first side, the generally flat surface is operably connectable to the hook portion to attach the generally flat surface to the first side of the goal;

wherein each remaining side of the polyhedron is open; and a plurality of stakes, wherein when each of the stakes engages a goal edge of the plurality of goal edges at a bottom side of the goal, and the stakes are secured to a surface on which the bottom side of the goal is supported, shifting of the goal is inhibited.

2. The game device, according to claim 1, further comprising:

a court perimeter comprising a flexible material formable into a shape that is at least one of a circle, an oval, a square, a convex polygon, and a concave polygon, wherein the court perimeter defines an area completely surrounding the goal.

3. The game device according to claim 2, wherein when viewed from above the goal overlaps a center of the area defined by the court perimeter.

4. The game device according to claim 1, further comprising:

a plurality of stakes arranged at the court perimeter, wherein the stakes engage the court perimeter and are secured to a surface on which the court perimeter is supported to inhibit shifting of the court perimeter.

5. The game device of claim 1, wherein the goal has six sides.

6. The game device, according to claim 5, further comprising:

a court perimeter comprising a flexible material formable into a shape that is at least one of a circle, an oval, a square, a convex polygon, and a concave polygon, wherein the court perimeter defines an area completely surrounding the goal.

7. The game device according to claim 6, wherein when viewed from above the goal overlaps a center of the area defined by the court perimeter.

8. The game device, according to claim 1, wherein a goal edge connector of the plurality of goal edge connectors comprises lengths, wherein each length comprises a corner shaped shoulder from which extends a cylindrical protruding part and to which respective goal edges are engaged to form the polyhedron shape of the goal.

9. The game device, according to claim 8, wherein the plurality of goal edge connectors comprise eight goal edge connectors, wherein each of the eight goal edge connectors comprises a first protruding part, a second protruding part, and a third protruding part, wherein when the goal edges are respectively engaged with the plurality of goal edge connectors, the goal has a cube shape.

10. The game device according to claim 1, wherein the plurality of goal edge connectors each comprises lengths that extend at 60° angles from the elbow.

11. The game device according to claim 1, wherein some of the plurality of goal edge connectors each comprises a length that extends at a 60° angle and a length that extends at a 90° angle from the elbow.

12. The game device according to claim 1, wherein the plurality of goal edge connectors each comprises three lengths such that, when respectively engaged with the plurality of goal edges, a prism-shaped goal is formed.

13. The game device according to claim 1, wherein the goal has 4 sides.

14. The game device according to claim 13, wherein the plurality of goal edge connectors each comprises three lengths that all extend at 60° angles from the elbow, wherein when the plurality of goal edge connectors are respectively engaged with the plurality of goal edges a tetrahedron-shaped goal is formed.

15. The game device, according to claim 13, further comprising:

a court perimeter comprising a flexible material formable into a shape that is at least one of a circle, an oval, a square, a convex polygon, and a concave polygon, wherein the court perimeter defines an area completely surrounding the goal.

16. The game device according to claim 15, wherein when viewed from above the goal overlaps a center of the area defined by the court perimeter.

17. The game device according to claim 1, wherein the goal has 5 sides.

18. The game device according to claim 17, wherein one of the plurality of goal edge connectors comprises four lengths such that, when respectively engaged with the plurality of goal edges, a pyramid-shaped is formed.

19. The game device, according to claim 17, further comprising:

a court perimeter comprising a flexible material formable into a shape that is at least one of a circle, an oval, a square, a convex polygon, and a concave polygon, wherein the court perimeter defines an area completely surrounding the goal.

20. The game device according to claim 19, wherein when viewed from above the goal overlaps a center of the area defined by the court perimeter.

* * * * *